US007093404B2

(12) United States Patent
Kubo et al.

(10) Patent No.: US 7,093,404 B2
(45) Date of Patent: Aug. 22, 2006

(54) BAG MANUFACTURING AND PACKAGING APPARATUS

(75) Inventors: Michihiro Kubo, Ritto (JP); Masashi Kondo, Ritto (JP); Akira Yamamoto, Ritto (JP); Yukio Nakagawa, Ritto (JP); David Payne, Birmingham (GB)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 10/648,472

(22) Filed: Aug. 27, 2003

(65) Prior Publication Data

US 2004/0043882 A1 Mar. 4, 2004

(30) Foreign Application Priority Data

Aug. 29, 2002 (JP) ..... 2002-251844
Aug. 29, 2002 (JP) ..... 2002-251845

(51) Int. Cl.
*B65B 61/14* (2006.01)

(52) U.S. Cl. ..... 53/136.1; 53/135.1; 53/531; 53/591

(58) Field of Classification Search ..... 53/135.1, 53/531, 591, 136; 156/556
See application file for complete search history.

(56) References Cited

U.S. PATENT DOCUMENTS 3,587,843 A 6/1971 Wing et al.
3,864,895 A 2/1975 Petrea
4,057,197 A * 11/1977 Rottmann ..... 242/560.1
5,433,060 A * 7/1995 Gur et al. ..... 53/413
5,718,098 A * 2/1998 Grosskopf et al. ..... 53/397
6,138,442 A * 10/2000 Howard et al. ..... 53/477
6,460,312 B1 * 10/2002 Nakagawa et al. ..... 53/55
6,481,184 B1 * 11/2002 Junker et al. ..... 53/413
6,726,794 B1 * 4/2004 Belt ..... 156/265
6,840,391 B1 * 1/2005 Miller et al. ..... 211/113

FOREIGN PATENT DOCUMENTS

WO WO-98/52823 A 11/1998

* cited by examiner

*Primary Examiner*—Scott A. Smith
*Assistant Examiner*—Gloria R. Weeks
(74) *Attorney, Agent, or Firm*—SHINJYU Global IP

(57) ABSTRACT

An aim is to provide a bag manufacturing and packaging apparatus which is able to conduct a bag manufacturing at high speed, further to be small in height.

A bag manufacturing and packaging apparatus 1 comprises a bag manufacturing unit that includes a transverse sealing mechanism 17 and a strip mounting unit that includes a transfer mechanism 32. The bag manufacturing unit manufactures bags filled with articles. The transfer mechanism 32 transfers bags manufactured by the bag manufacturing unit diagonally downward. The strip mounting unit mounts bags B to a strip S after they are transferred by means of the transfer mechanism 32.

15 Claims, 15 Drawing Sheets

BAG MANUFACTURING AND PACKAGING APPARATUS

BACKGROUND OF THE INVENTION

1. Field of the Invention

The present invention relates to a bag manufacturing and packaging apparatus, and more particularly to a bag manufacturing and packaging apparatus having a function that mounts a manufactured bag to a strip.

2. Background Information

There are bag manufacturing and packaging apparatuses that, while manufacturing a bag, fill the bag with articles to be packaged, such as snacks and candies, thereby functioning as an apparatus that manufactures a bag and packages. For example, in a vertical bag manufacturing and packaging apparatus called a pillow-type packaging machine, a packaging material that is a sheet-shaped film is formed into a tubular shape by the use of a former and a tube. Subsequently, the longitudinal edges of overlapping tubular packaging materials are heat-sealed (welded) by a longitudinal sealing mechanism, thereby making a tubular packaging material. Furthermore, the tubular packaging material that will ultimately form a bag is filled from the tube with articles to be packaged. Then, the transverse sealing mechanism below the tube heat seals the upper end of the bag and the lower end of the following bag, and a cutter then cuts the center of the heat-sealed portion (transverse sealed portion).

It has also been proposed to add a function to a bag manufacturing and packaging apparatus that fixedly attaches manufactured bags to a strip. Such apparatuses fixedly attaches bags to a strip, leaving spaces between the bags a little bit at a time. Thereby, the plurality of bags, in which snacks, candies, and the like are packaged, can be easily arrayed at a retail shop by hanging the end of the strip.

Published Japanese translation of PCT Application WO1997-508879 discloses an apparatus in which a transverse sealing mechanism heat seals the upper and lower ends of a bag and simultaneously fixedly attaches the bag to a strip. In addition, U.S. Pat. No. 3,864,895 discloses an apparatus that transfers a manufactured bag in the horizontal direction, and then fixedly attaches the bag to a strip. Furthermore, International Publication No. 98-52823 discloses an apparatus that transfers a manufactured bag directly downward, and then fixedly attaches the bag to a strip.

The apparatus disclosed in U.S. Pat. No. 3,864,895 feeds the tubular packaging material from above in the downward direction, transports in the horizontal direction bags whose upper and lower ends have been sealed by a transverse sealing mechanism, and then fixedly attaches the bag to a strip. In other words, a bag is dropped to a space below the transverse sealing mechanism, and is then transferred horizontally. Further, the bag is fixedly attached to a strip at a position planarly spaced apart from the transverse sealing mechanism.

However, it is difficult for the apparatus disclosed in U.S. Pat. No. 3,864,895 to continuously manufacture bags at a high speed because it adopts a configuration wherein tubular packaging material is transported from above in the downward direction. That is, bags are sealed at the upper and lower ends by a transverse sealing mechanism, and those bags are then transferred in a horizontal direction, which is orthogonal to the direction in which they have been transported. In other words, such an apparatus manufactures bags and fixedly attaches those bags to a strip intermittently, which limits the number of bags that can be manufactured per a unit of time.

Further, in the apparatus disclosed in International Publication No. 98-52823, the packaging material is transported from above in the downward direction, bags are manufactured by a transverse sealing mechanism, and those bags are transferred directly downwards without changing the transfer direction, which is from above to below, where the bags are fixedly attached to a strip at a position considerably lower than the transverse sealing mechanism. Accordingly, unlike the apparatus of U.S. Pat. No. 3,864,895, it appears that the apparatus disclosed in International Publication No. 98-52823 can manufacture bags continuously and at a high speed.

However, because the apparatus in International Publication No. 98-52823 has a configuration in which manufactured bags are transported directly downward and then fixedly attached to a strip, the apparatus requires the securing of a long distance in the height direction between the mechanism that attaches bags to the strip and the transverse sealing mechanism, in order to ensure high speed operation. If this distance were short, there would be a risk that the next bag to be manufactured would interfere with the previous bag being attached to a strip. In consideration thereof, the mechanism that fixedly attaches bags to a strip is disposed considerably below the transverse sealing mechanism in the apparatus of International Publication No. 98-52823. Accordingly, the apparatus of International Publication No. 98-52823 has a large overall height dimension, which is undesirable.

In addition, to increase the number of bags that can be manufactured per unit of time by the bag manufacturing and packaging apparatus, the sealing members of the transverse sealing mechanism are moved in concert with the transport of the tubular packaging material, and the upper and lower ends of the bag are heat-sealed by the application of pressure and heat from the sealing members while both the tubular packaging material, which will form the bag, and the sealing members are moved together. For example, there is a bag manufacturing and packaging apparatus that moves a pair of sealing members of a transverse sealing member downward while the sealing members revolve, so as to describe a rectangular trajectory or a D-shaped trajectory. In this manner, bags can be manufactured without any stoppage of the transport of the tubular packaging material that forms the bags.

In bag manufacturing and packaging apparatuses of the type that move the sealing members downward in concert with the transport of the bag in order to manufacture bags, the length of time during which the pair of sealing members grasp the ends of the bag, namely the length of time that pressure and heat from the sealing members are applied to the ends of the bag (packaging material), varies depending on the type of packaging material and size of the bag to be manufactured. In other words, the distance that the pair of sealing members move downward while grasping the packaging material that will form the bag varies depending on the type of packaging material and size of the bag to be manufactured. Furthermore, in a conventional bag manufacturing and packaging apparatus, if the length of time during which the sealing members grasp the ends of the bag must be increased, then the distance that the pair of sealing members move downward while grasping the packaging material that will form the bag needs to be lengthened. Conversely, if it is acceptable to shorten the length of time that the sealing members grasp the ends of the bag, then the distance that the pair of sealing members moves downward while grasping the packaging material that will form the bag is shortened. Consequently, in a conventional bag manufacturing and packaging machine, the height position and the timing at which the pair of sealing members separates from the grasped packaging material (ends of the bag) varies depending on the type of packaging material and the size of the bag.

However, if the height position of the bag varies when the upper and lower ends of the bag are heat-sealed by the transverse sealing mechanism of the bag manufacturing and packaging apparatus and the manufacturing of the bag is completed, then the mechanism that fixedly attaches that bag to a strip must estimate the height position of the bag that has been manufactured based on the size of the bag and the type of packaging material. Particularly, the mechanism that fixedly attaches the bag to the strip must be configured so that it can deal with that change in the height position. Thereby, the cost of the mechanism needed to fixedly attach bags to a strip increases. It is also necessary to finely control the mechanism based on the height position of the bag being manufactured.

In view of the above, there exists a need for a bag manufacturing and packaging apparatus which overcomes the above mentioned problems in the prior art. This invention addresses this need in the prior art as well as other needs, which will become apparent to those skilled in the art from this disclosure.

SUMMARY OF THE INVENTION

It is a purpose of the present invention to provide a bag manufacturing and packaging apparatus that can manufacture bags at a high speed and reduce the height of the apparatus.

It is another object of the present invention to provide a bag manufacturing and packaging apparatus that reduces the complexity of control or of the configuration of the mechanism (mounting unit) that mounts bags, wherein the transverse sealing mechanism has completed the sealing of the ends of each bag, to a strip.

The bag manufacturing and packaging apparatus according to the first aspect of the invention includes a bag manufacturing unit and a mounting unit. The bag manufacturing unit manufactures bags filled with articles. The mounting unit mounts bags manufactured by the bag manufacturing unit to a strip, and has a transfer mechanism and a fixing mechanism. The transfer mechanism transfers bags manufactured by the bag manufacturing unit diagonally downward. The fixing mechanism affixes bags to the strip after the transfer mechanism transfers the bags.

In the present claim, the transfer mechanism of the mounting unit transfers bags manufactured by the bag manufacturing unit diagonally downward. Thus, the diagonal transfer direction of the bags enables the smooth movement of the bag during the series of operations from the manufacturing of the bag to the mounting of the bags to the strip by the mounting unit. Thereby, even if bags are manufactured in the bag manufacturing unit at a high speed, few difficulties arise in the mounting of bags in the mounting unit.

In addition, the transfer mechanism of the mounting unit in this aspect of the invention transfers bags manufactured by the bag manufacturing unit diagonally downward, instead of directly downward. Consequently, it is possible to reduce the distance that the transfer mechanism transfers the bag along the vertical direction of the bag when an attempt is made such that the previous bag does not interfere with the bag subsequently manufactured by the bag manufacturing unit. For example, if the length of a bag in the vertical direction is long and the bag is thin, then the transfer distance in the vertical direction will need to be at least as long as the length of the bag if the bag is transferred directly downward. However, if the bags are transferred diagonally downward, and the bag is made planar to the extent of the thickness dimension, the next bag does not interfere with the previous bag even if they are not separated by the length of the bag in the vertical direction and overlap with one another. Thus, the bag manufacturing and packaging apparatus according to the first aspect of the invention has a structure that avoids interference between the previous bag and the next bag even if bags are manufactured continuously at a high speed. Further, bags that have been transferred by the transfer mechanism are fixed, by a method such as bonding or welding, to a strip that has been transported to the fixing mechanism. This structure is implemented while reducing the distance by which the transfer mechanism transfers bags along the vertical direction.

The bag manufacturing and packaging apparatus according to the second aspect of the invention is the bag manufacturing and packaging apparatus as recited in the first aspect, wherein the bag manufacturing unit discharges manufactured bags downward. In addition, the transfer mechanism transfers bags to a position in which a bag that will be mounted to a strip will not interfere with the next bag that will be discharged from the bag manufacturing unit.

In this aspect of the invention, interference between the bag mounted to a strip by the mounting unit and the next bag discharged from the bag manufacturing unit is reliably controlled.

The bag manufacturing and packaging apparatus according to the third aspect of the invention is the bag manufacturing and packaging apparatus as recited in the first or second aspect, wherein the bag manufacturing and packaging apparatus further has a strip roll and a strip transport unit. The strip roll reels out the strips. The strip transport unit transports strips reeled out from the strip roll to the fixing mechanism.

In this aspect of the invention, the strips reeled out from the strip roll are transported to the fixing mechanism by the strip transport unit.

The bag manufacturing and packaging apparatus according to the fourth aspect of the invention is the bag manufacturing and packaging apparatus as recited in the third aspect, further having a tension control mechanism. The tension control mechanism is a mechanism that maintains the tension of a strip transported by the strip transport unit in a predetermined range.

In this aspect of the invention, because the tension of the strip is maintained in a predetermined range by the tension control mechanism, the fixing mechanism of the mounting unit stably affixes bags to a strip, making it possible to reduce the number of problems, such as bags not being affixed to a strip.

The bag manufacturing and packaging apparatus according to the fifth aspect of the invention is the bag manufacturing and packaging apparatus as recited in the third aspect, wherein the strip transport unit transports a plurality of strips to the fixing mechanism. Further, the fixing mechanism fixes bags to at least one of the plurality of strips.

In the present claim, a plurality of strips is transported to the fixing mechanism, and bags are affixed to the strips. For example, two strips arranged in parallel are transported to the fixing mechanism, and bags are welded to both of the strips. Consequently, even if a bag does not get affixed to one of the strips, the objective of affixing the bag to a strip can be achieved if the bag is affixed to the other strip. In addition, the reliability of fixing bags to strips increases if the bags are affixed to a plurality of strips.

Furthermore, instead of a plurality of strips, it is also conceivable to transport to the fixing mechanism a single strip having a width equivalent to the plurality of strips. However, transporting a plurality of narrow strips has the advantage of reducing meandering of the strips during transport compared with the transport of a single wide strip.

The bag manufacturing and packaging apparatus according to the sixth aspect of the present invention is the bag manufacturing and packaging apparatus as recited in the third aspect, further including a remaining amount detecting unit. The remaining amount detecting unit detects the amount of strips remaining in the strip roll.

In the present claim, the detection of the amount of strips remaining in the strip roll by the remaining amount detecting unit makes it convenient for the operator to perform operations like replacing the strip roll.

Furthermore, it is also acceptable for the remaining amount detecting unit to detect an end mark attached to the strip roll, or to detect the thickness of a predetermined portion of the strip roll, or to detect with a photoelectric sensor the presence of a strip reeled out from the strip roll, or to detect the tension of the strips reeled out from the strip roll. It is thus possible to detect the amount of strips remaining in the strip roll by any one of these detection methods.

The bag manufacturing and packaging apparatus according to the seventh aspect of the present invention is the bag manufacturing and packaging apparatus as recited in the first or second aspect, wherein there is an open space below the bag manufacturing unit on a front side relative to a point where the bag manufacturing unit releases the bags downward. Further, the transfer mechanism transfers bags toward the rear side. In addition, the bag manufacturing and packaging apparatus further includes a strip-attached-bag discharge unit. The strip-attached-bag discharge unit discharges bags mounted onto the strip by the fixing mechanism toward the front side.

The bag manufacturing and packaging apparatus according to the eighth aspect of the present invention includes a bag manufacturing unit and a mounting unit. The bag manufacturing unit manufactures bags filled with articles. The bag manufacturing unit includes a transverse sealing mechanism that seals vertical ends of bags. The transverse sealing mechanism has a pair of sealing members. The pair of sealing members grasps both ends of a bag and applies heat and pressure while moving downward to seal the ends. The pair of sealing members releases the ends of a bag at a release position, which is fixed within the bag manufacturing and packaging apparatus without regard to a distance by which the pair of sealing members moves downward while grasping the bag. The mounting unit has a fixing mechanism that affixes bags that are manufactured by the bag manufacturing unit to a strip at a fixing position.

In the present claim, a pair of sealing members of the transverse sealing mechanism in the bag manufacturing unit applies pressure and heat to the ends of a bag while the sealing members move downward. Thereby, bags whose ends are sealed are mounted in the mounting unit to a strip. Further, the operation of sealing the ends of the bag by the transverse sealing mechanism is completed by the pair of sealing members releasing their grasp of the ends of the bag. A bag thus manufactured is mounted in the mounting unit to a strip. In such operation of the mounting unit mounting the bag to a strip, unless the position of the manufactured bag in the previous stage is fixed, it becomes necessary to introduce a complex configuration or control in the mounting unit so as to accommodate differences in the position of the bags. To avoid such complexity and to simplify the configuration and control of the mounting unit, the release position in the present claim is made fixed within the bag manufacturing and packaging apparatus. In other words, the vertical position at which the pair of sealing members releases their grasp of the ends of the bag is fixed, thereby reducing the complexity of the configuration and control of the mounting unit.

The bag manufacturing and packaging apparatus according to the ninth aspect of the present invention is the bag manufacturing and packaging apparatus as recited in the eighth aspect, wherein the mounting unit has a holding mechanism that holds bags manufactured by the bag manufacturing unit. The holding position at which the holding mechanism holds bags is fixed based upon the release position.

When the holding mechanism of the mounting unit holds a manufactured bag in the present claim, that holding position is fixed. This is because the sealing operation, which is completed by the pair of sealing members releasing their grasp, must end at the fixed release position. In other words, because the release position is fixed, the holding position of the holding mechanism, which holds the bag, can also be made fixed within the bag manufacturing and packaging apparatus.

Furthermore, it is acceptable for the holding mechanism to hold the end of the bag by grabbing it, or by using a suction mechanism.

The bag manufacturing and packaging apparatus according to the tenth aspect of the present invention is the bag manufacturing and packaging apparatus as recited in the ninth aspect, wherein the fixing position is spaced away from said holding position, and the mounting unit further has a transfer mechanism. The transfer mechanism transfers the holding mechanism such that bags held by the holding mechanism are moved from the holding position to the fixing position. Namely, the transfer mechanism transfers bags from the holding position to the fixing position by transferring the holding mechanism that holds the bags.

In the present claim, the transfer mechanism transfers the holding mechanism, which holds a bag. This transfer operation transfers the bag from the holding position to the fixing position. Furthermore, the bag is fixed to the strip at the fixing position. Thus, because the holding position is fixed in the bag manufacturing and packaging apparatus of the present claim, wherein the bag manufacturing and packaging apparatus has a configuration that transfers the holding mechanism from the fixing position side to the holding position side and then holds the bag, the control of the transfer mechanism, which transfers the holding mechanism, can be simplified. Accordingly, the configuration of the transfer mechanism remains uncomplicated.

The bag manufacturing and packaging apparatus according to the eleventh aspect of the present invention is the bag manufacturing and packaging apparatus as recited in the tenth aspect, wherein the holding position and the fixing position are offset in a front-rear direction.

Because the holding position and the fixing position differ in the this aspect of the invention, the transfer mechanism must transfer the holding mechanism in a direction that includes a horizontal component. Accordingly, unless the holding position is fixed, the configuration and control of the transfer mechanism will become complicated, which is undesirable. However, in the bag manufacturing and packaging apparatus of the eighth aspect, the holding mechanism is fixed, and therefore the configuration and control of the transfer mechanism can be simplified.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following description of the embodiments of the present invention is provided for illustration only, and not for the purpose of limiting the invention as defined by the appended claims and their equivalents.

General Overview

Figure 1:
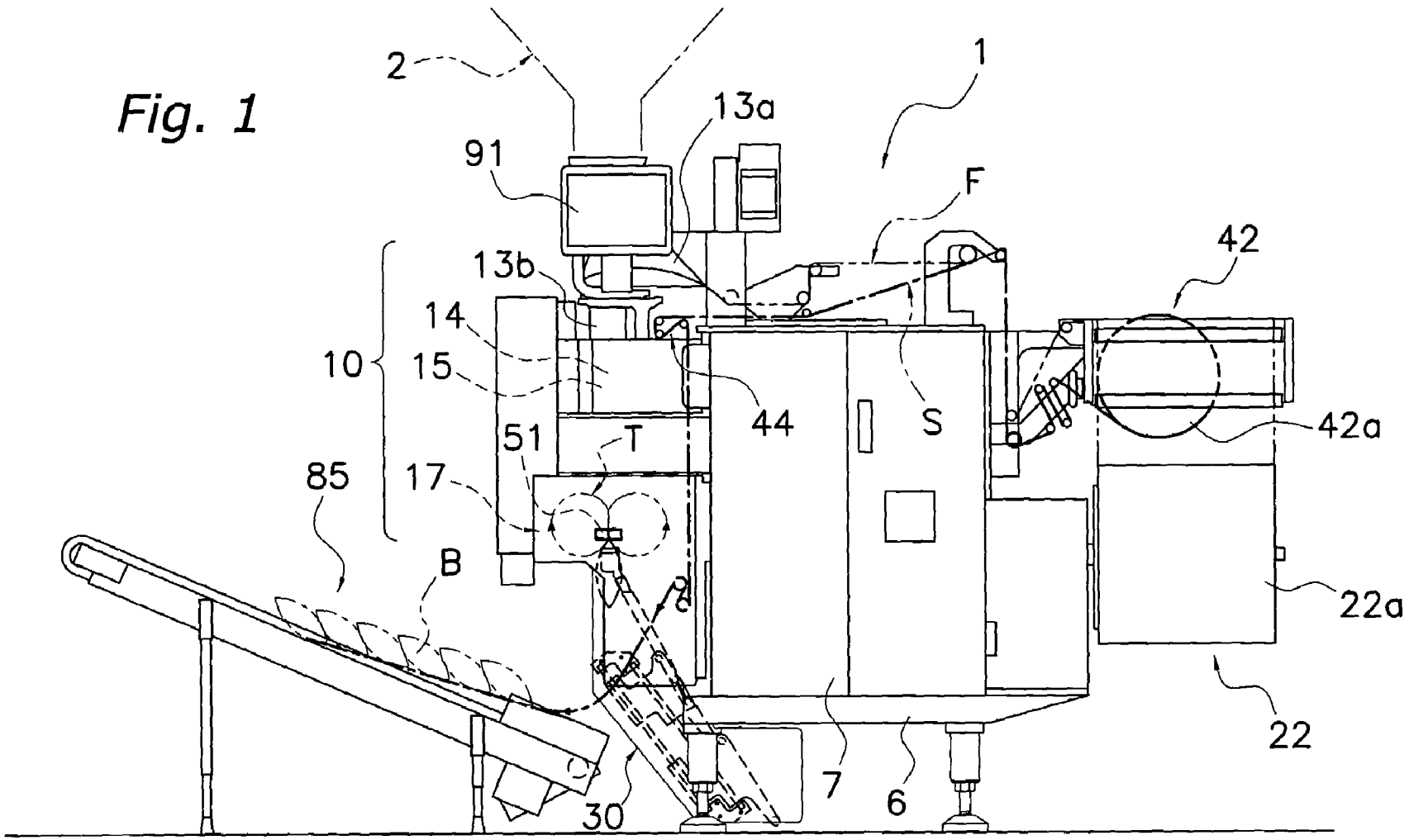
FIG. 1 is a side view of the bag manufacturing and packaging apparatus according to one embodiment of the present invention.
Figure 2:
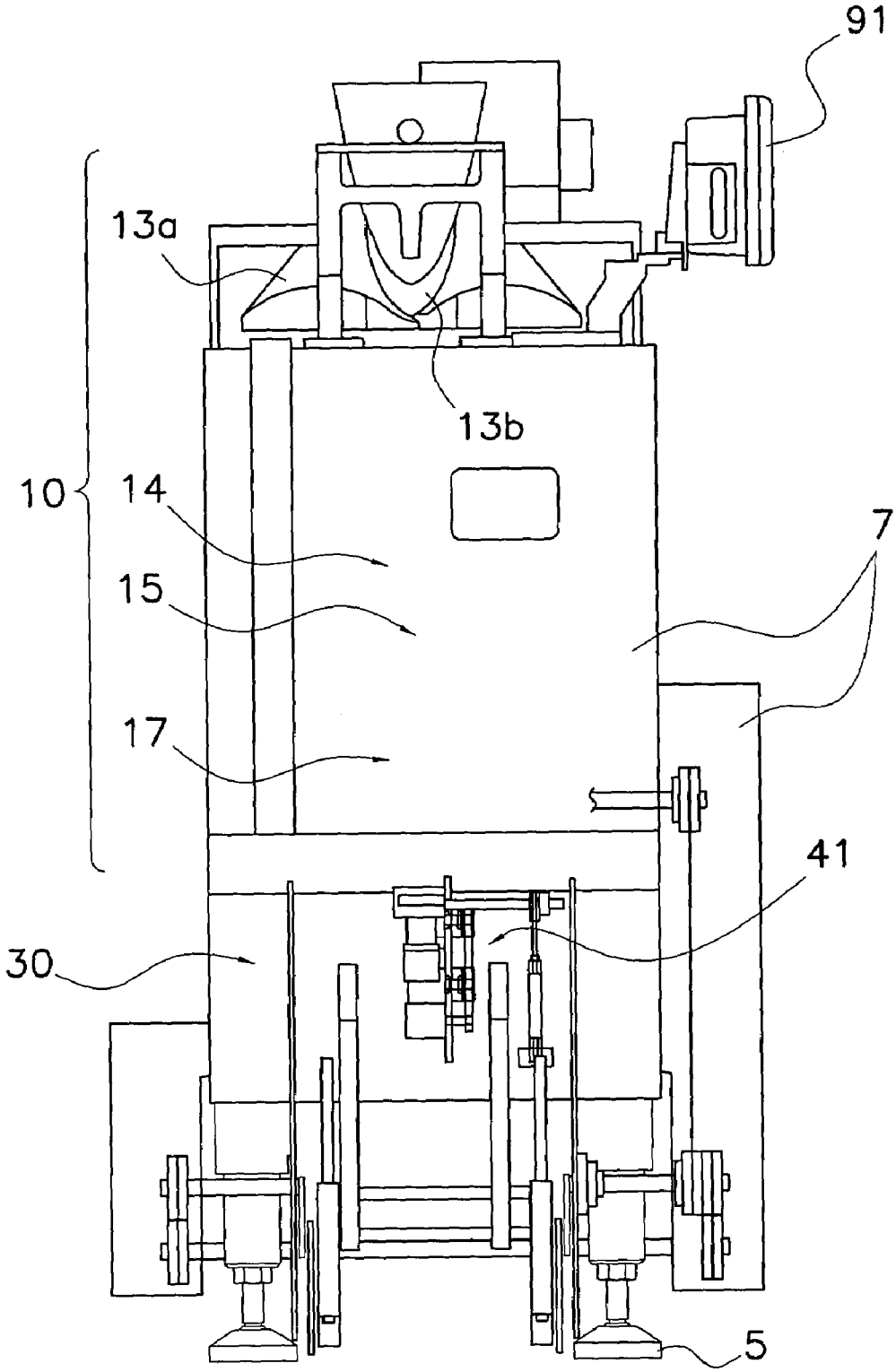
FIG. 2 is a front view of the bag manufacturing and packaging apparatus according to the embodiment of the present invention.

FIG. 1 and FIG. 2 respectively show a side view and a front view of a vertical-type bag manufacturing and packaging apparatus 1 according to one embodiment of the present invention. The bag manufacturing and packaging apparatus 1 is a machine that manufactures a bag by covering foodstuffs like potato chips (hereinafter, foodstuffs is referred to as potato chips) with a film, and then longitudinally and transversely sealing the film which has been formed into a tubular shape. In addition, the bag manufacturing and packaging apparatus 1 has an additional function of mounting manufactured bags to a strip. Hereinafter, the left hand side of FIG. 1, which is the direction toward which the bags are transferred as the bags are manufactured and attached to the strip, is referred to as the front side of the bag manufacturing and packaging apparatus 1, while the right hand side is referred to as the rear side of the bag manufacturing and packaging apparatus 1.

Furthermore, the present invention is constituted so that, in principle, predetermined weights of potato chips drop from a weigher 2 that is provided above the bag manufacturing and packaging apparatus 1.

Figure 11:
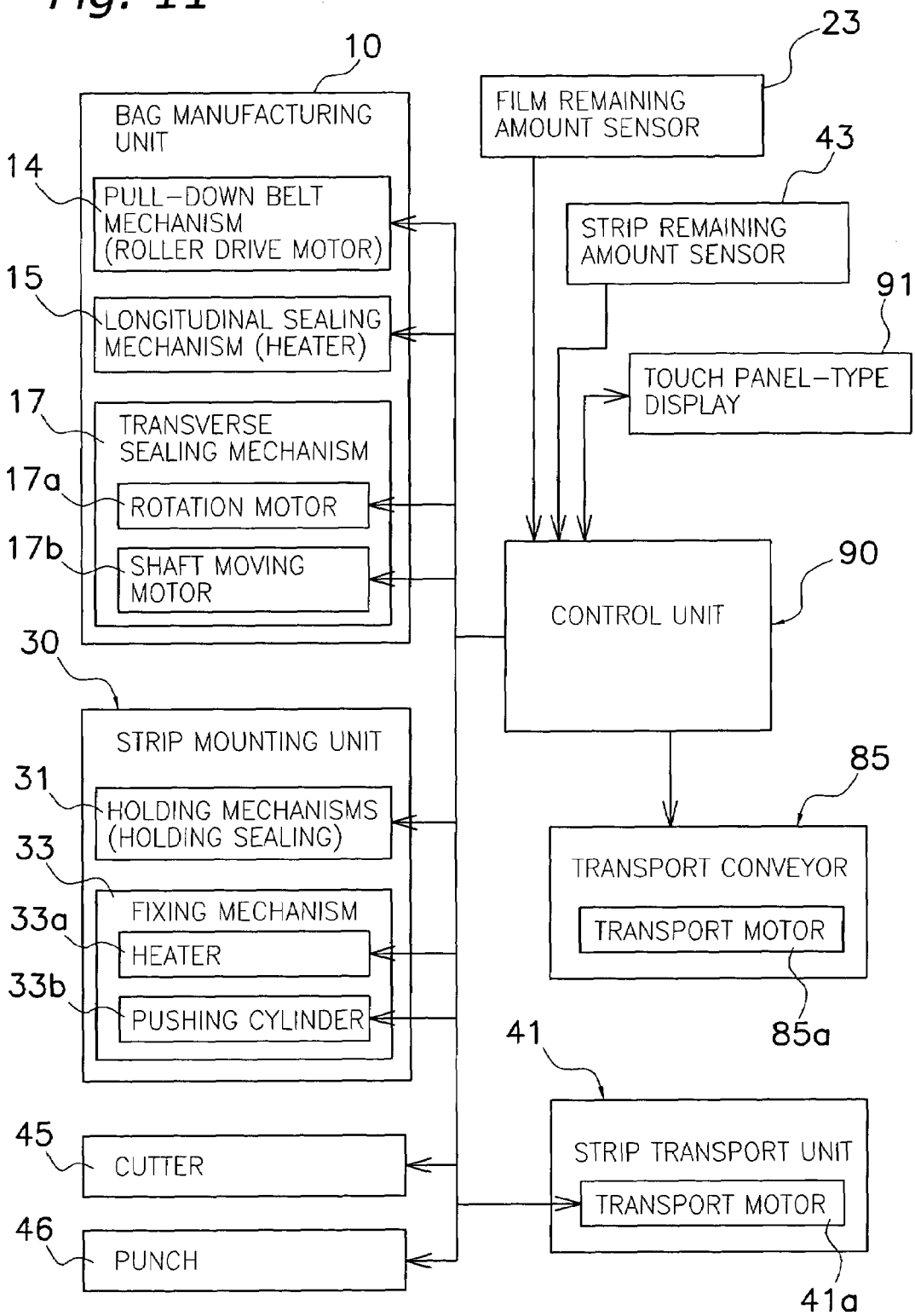
FIG. 11 is a control block diagram according to the embodiment of the present invention.

The bag manufacturing and packaging apparatus 1 includes a bag manufacturing unit 10, a film roll holding unit 22, a strip mounting unit 30, a strip transport unit 41, a strip roll holding unit 42, a transport conveyor 85, and a control unit 90 (refer to FIG. 11). Except for the transport conveyor 85, each of the units is affixed to or supported by a frame 6, which is supported by four legs 5. The majority of the above-mentioned units are covered by casings 7 for safety reasons.

Film Roll Holding Unit 22

The film roll holding unit 22 holds a film roll 22*a*, which unreels a sheet-shaped film F to a former 13*a* of the bag manufacturing unit 10, which is discussed later. The film F is wrapped around the film roll 22*a*. The tension of the film F reeled out from the film roll 22*a* is maintained within a predetermined range by a dancer roller and the like, thereby reducing slack and meandering during transport.

In addition, a film remaining amount sensor 23 (refer to FIG. 11) that detects the remaining amount of film F wrapped around the film roll 22*a* is disposed in the vicinity of the film roll holding unit 22.

Bag Manufacturing Unit 10

Figure 3:
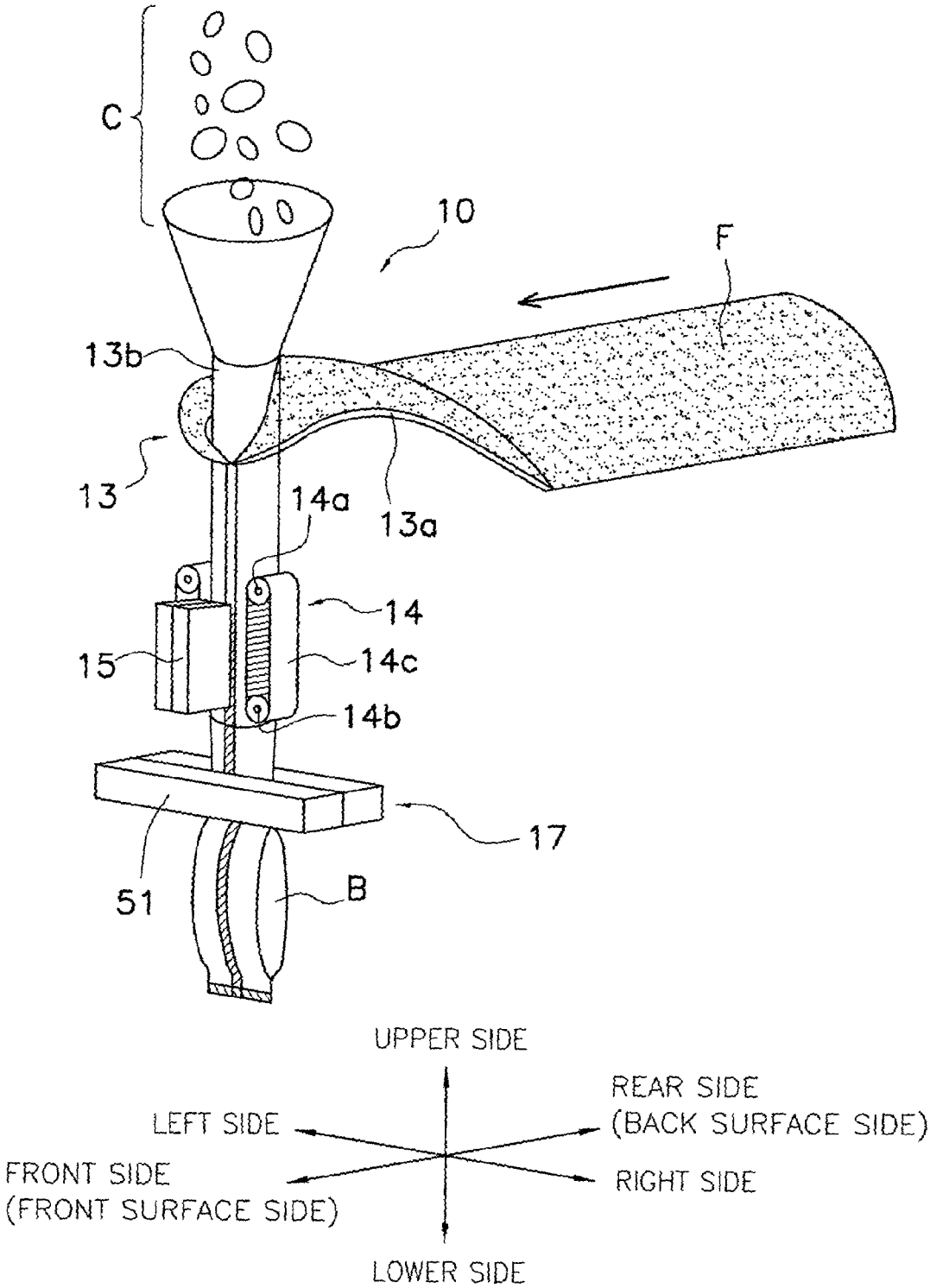
FIG. 3 is a schematic perspective view of the bag manufacturing unit according to the embodiment of the present invention.

As shown in FIG. 3, the bag manufacturing unit 10 has a forming mechanism 13 that forms the sheet-shaped film F fed to it into a tubular shape, a pull down belt mechanism 14 that transports the tubularly formed film F (herein below, referred to as tubular film) downward, a longitudinal sealing mechanism 15 that longitudinally seals overlapping portions of the tubular film, and a transverse sealing mechanism 17 that seals the upper and lower ends of a bag B by transversely sealing the tubular film.

Forming Mechanism 13

The forming mechanism 13 has a tube 13*b* and the former 13*a*. The tube 13*b* is a cylindrical-shaped member that has an opening at the upper and lower ends. Potato chips C that were weighed by the weigher 2 are fed into the opening at the upper end of the tube 13*b*. The former 13*a* is disposed so that it surrounds the tube 13*b*. The shape of the former 13*a* is such that the sheet-shaped film F unreeled from the film roll 22*a* is formed tubularly when the film F passes between the former 13*a* and the tube 13*b*. In addition, the tube 13*b* and the former 13*a* of the forming mechanism 13 can be exchanged with tubes and formers of different size according to the size of the bag to be manufactured.

Pulldown Belt Mechanism 14

The pull down belt mechanism 14 is a mechanism that sucks and downwardly transports the tubular film that is wrapped around the tube 13*b*. As shown in FIG. 3, belts 14*c* are provided on the left and right sides of and interpose the tube 13*b*. In the pull down belt mechanism 14, drive rollers 14*a* and follower rollers 14*b* rotate the belts 14*c*, which has a sucking function, thereby transporting the tubular film downward. Furthermore, a roller drive motor (not shown in FIG. 3) rotates the drive rollers 14*a*, and the like. Since the roller drive motors is a conventional component that is well known in the art, its structure will not be discussed or illustrated in detail herein.

Longitudinal Sealing Mechanism 15

The longitudinal sealing mechanism 15 is a mechanism that performs longitudinal sealing by concurrently heating and pressing, against the tube 13*b* and with a constant pressure, the overlapping portion of the tubular film that is wrapped around the tube 13*b*. The longitudinal sealing mechanism 15 is positioned on the front side of the tube 13*b*, and has a heater and a heater belt. The heater belt is heated by that heater and contacts the overlapping portion of the tubular film.

Transverse Sealing Mechanism 17

Figure 4:
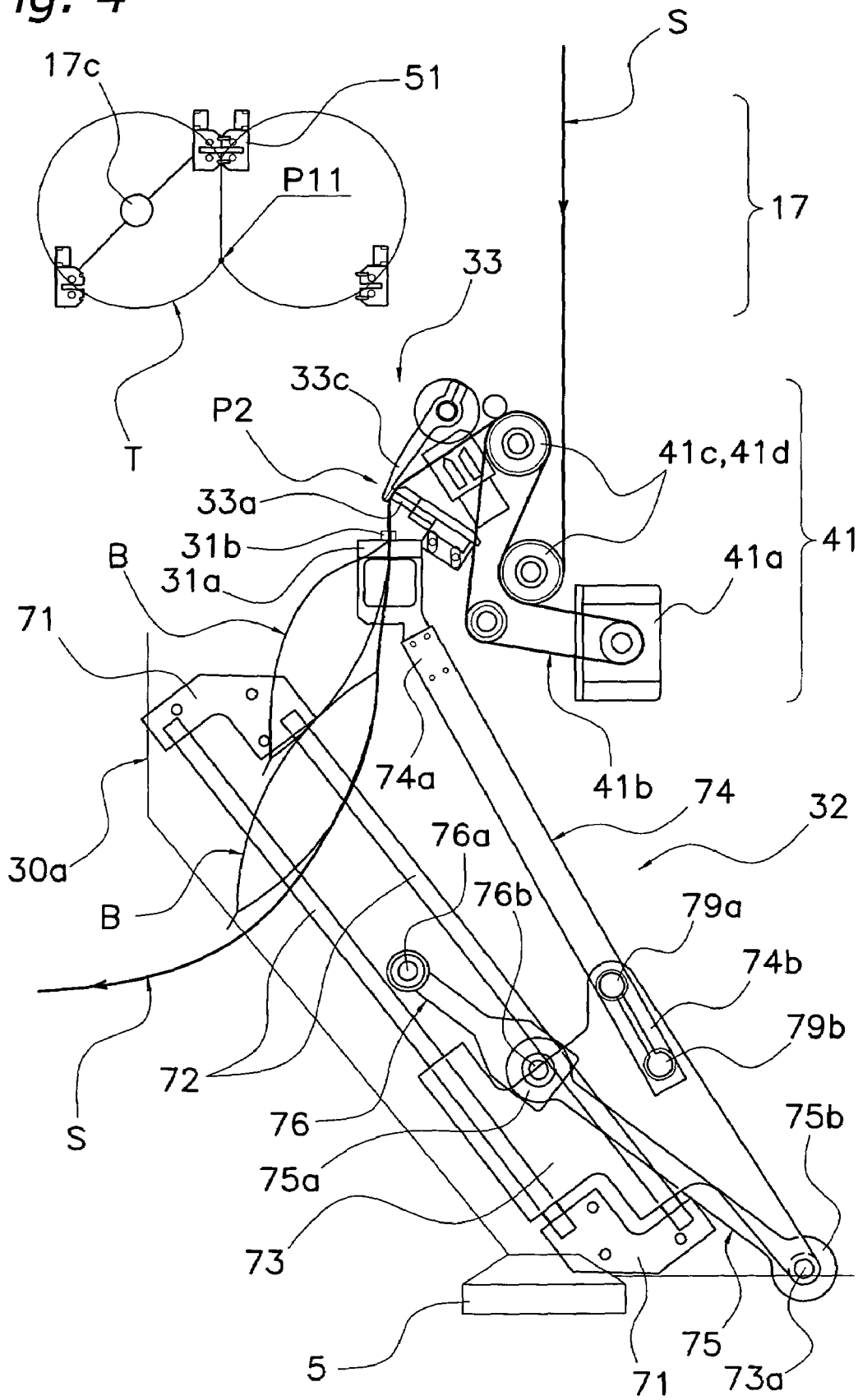
FIG. 4 is a schematic side view of the strip mounting unit and the strip transport unit according to the embodiment of the present invention.

The transverse sealing mechanism 17 is disposed below the forming mechanism 13, the pull down belt mechanism 14, and the longitudinal sealing mechanism 15. The transverse sealing mechanism 17 has a pair of sealing jaws (sealing members) 51, each having a built-in heater (refer to FIG. 4). The pair of sealing jaws 51 is respectively positioned on the front side and rear side of the tubular film, and, as shown in FIG. 1 and FIG. 4, revolve so that they define an approximately D-shaped trajectory T, which is front-rear symmetrical. Furthermore, at a midpoint in the revolution, the pair of sealing jaws 51 grasps the tubular film in a state wherein the pair of sealing jaws 51 presses against one another, and then performs sealing by applying pressure and heat to the portions of the tubular film that will form the upper and lower ends of the bag. The sealing jaw 51 positioned on the front side of the tubular film is supported by a shaft 17*c* so as to revolve around the shaft 17*c*. The shaft 17*c* rotates by the operation of a rotation motor 17*a* (refer to FIG. 11), and moves horizontally frontward and rearward via a ball screw mechanism (not shown) by the operation of a shaft moving motor 17*b*. In addition, the sealing jaw 51 positioned on the rear side of the tubular film likewise rotates by the operation of the rotation motor 17*a*, and moves horizontally frontward and rearward by the operation of the shaft moving motor 17*b*. Thus, the rotation and horizontal movement of the pair of sealing jaws 51 result in the approximately D-shaped trajectory T of the sealing jaws 51. In addition, the torque control of the shaft moving motor 17*b* adjusts the pressure when the pair of sealing jaws 51 interposes the tubular film. Since revolution motors and moving motors are conventional components that are well known in the art, their structures will not be discussed in detail herein.

In addition, the inside of one of the jaws of the pair of sealing jaws 51 has a built-in cutter (not shown). The built-in cutter is positioned at the center of the transverse sealing portion of the sealing jaws 51 in the height direction, and serves the purpose of cutting the bag B away from the following tubular film. The built-in cutters are conventional components that are well known in the art. Therefore, the structure of the built-in cutter will not be discussed or illustrated in detail herein.

Figure 12:
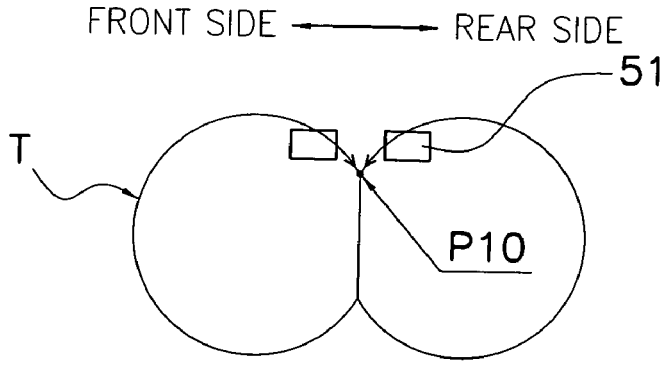
FIG. 12 shows the movement of the sealing jaws of the transverse sealing mechanism according to the embodiment of the present invention.
Figure 12:
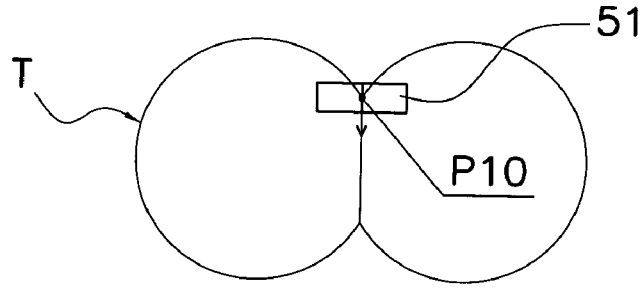
Figure 12:
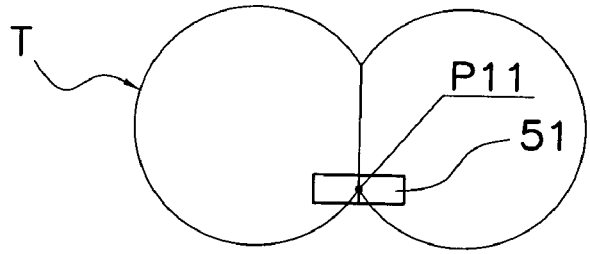
Figure 12:
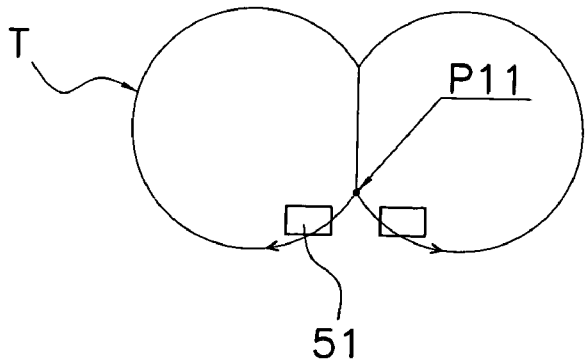
Figure 13:
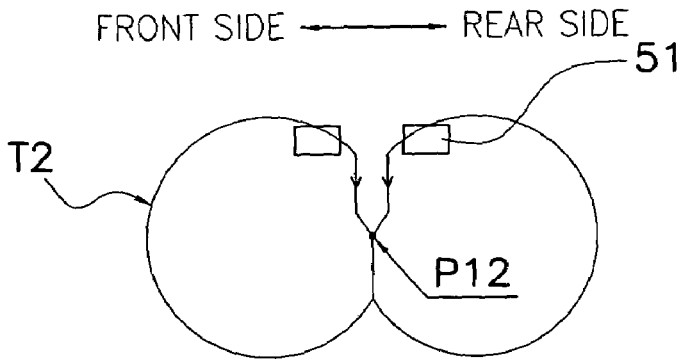
FIG. 13 shows another movement of the sealing jaws of the transverse sealing mechanism according to the embodiment of the present invention.
Figure 13:
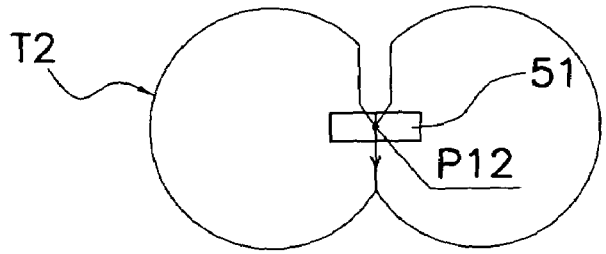
Figure 13:
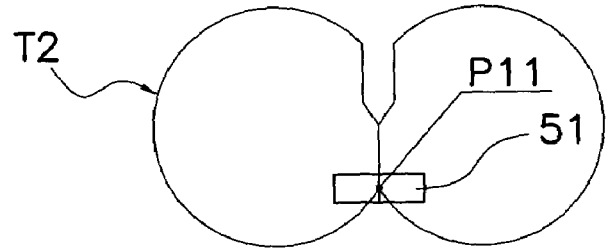
Figure 13:
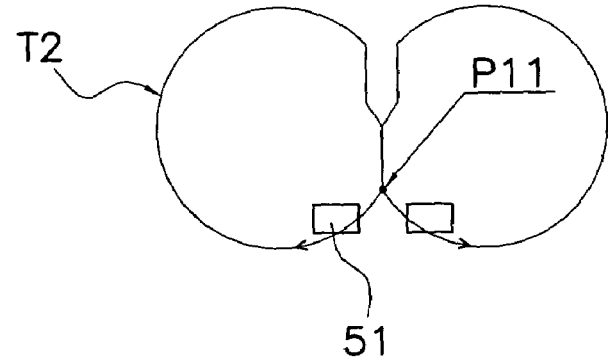

FIG. 12 and FIG. 13 show the transverse sealing operation performed by the pair of sealing jaws 51. FIG. 12 shows one example of the transverse sealing operation wherein the sealing jaws 51, which have come revolving around, grasp the tubular film at a point P10 (refer to FIG. 12(*a*) and FIG. 12(*b*)), apply pressure and heat to the tubular film while moving downward with the tubular film grasped between the sealing jaws 51, release their grasp of the tubular film at a point P11, and then separate apart from one another (refer to FIG. 12(*c*) and FIG. 12(*d*)). In other words, between the point P10 and the point P11, the sealing jaws 51 transversely seal the tubular film by applying pressure and heat to the tubular film while moving downward at the same speed as the tubular film. Further, the built-in cutter cuts the tubular film, and the bag B is discharged downward by releasing the grasp of the tubular film that has been formed into the bag B at the point P11 (refer to FIG. 9).

FIG. 13 shows another example of the transverse sealing operation. Therein, the sealing jaws 51 revolve around the shaft 17*c* while defining an approximately D-shaped trajectory T2 that is different from the trajectory T. The sealing jaws 51 that have come revolving around grasp the tubular film at a point P12, which is at a position lower than the abovementioned point P10 (refer to FIG. 13(*a*) and FIG. 13(*b*)). The sealing jaws 51 then add pressure and heat to the tubular film while moving downward, release their grasp of the tubular film at the point P11, and then separate apart from one another (refer to FIG. 13(*c*) and FIG. 13(*d*)). In other words, the sealing jaws 51 perform transverse sealing by applying pressure and heat to the tubular film while moving downward at the same speed as the tubular film from the point P12 to the point P11. Further, by cutting the tubular film with the built-in cutter and releasing the grasp of the tubular film that has formed the bag B at the point P11, the bag B is discharged downward.

The sealing time in the bag manufacturing and packaging apparatus 1 varies according to the size of the bag B to be manufactured and the material of the film F used. Principally, the change in the sealing time is the change in the time that the pair of sealing jaws 51 grasps the portions that form the upper and lower ends of the bag B. The sealing time can be changed by offsetting, i.e., varying the distance between the point at which the pair of sealing jaws 51 begin to grasp the tubular film that will form the bag B, and the point at which they release their grasp of the tubular film. Herein, as shown in FIG. 12 and FIG. 13, the sealing time is changed by offsetting the height position of the point at which the pair of sealing jaws 51 begins to grasp the tubular film that will form the bag B. The pair of sealing jaws 51 is controlled so that the height position of the point at which the pair of sealing jaws 51 releases its grasp (release position) of the tubular film that will form the bag B is fixed. In other words, as shown in FIG. 4, FIG. 12, and FIG. 13, the point 11 at which the pair of sealing jaws 51 releases its grasp of the tubular film that will form the bag B is relatively fixed within the bag manufacturing and packaging apparatus 1 regardless of the distance by which the pair of sealing jaws 51 moves downward while grasping the tubular film.

Strip Mounting Unit 30

The strip mounting unit 30 grabs the bag B at a position at which the sealing jaws 51 of the transverse sealing mechanism 17 separate from the manufactured bag B, and perform a mounting operation by transferring that bag B diagonally downward and then welding the bag B to a strip S. The strip mounting unit 30 has holding mechanisms 31, a transfer mechanism 32, and a fixing mechanism 33.

Holding Mechanisms 31

Figure 9:
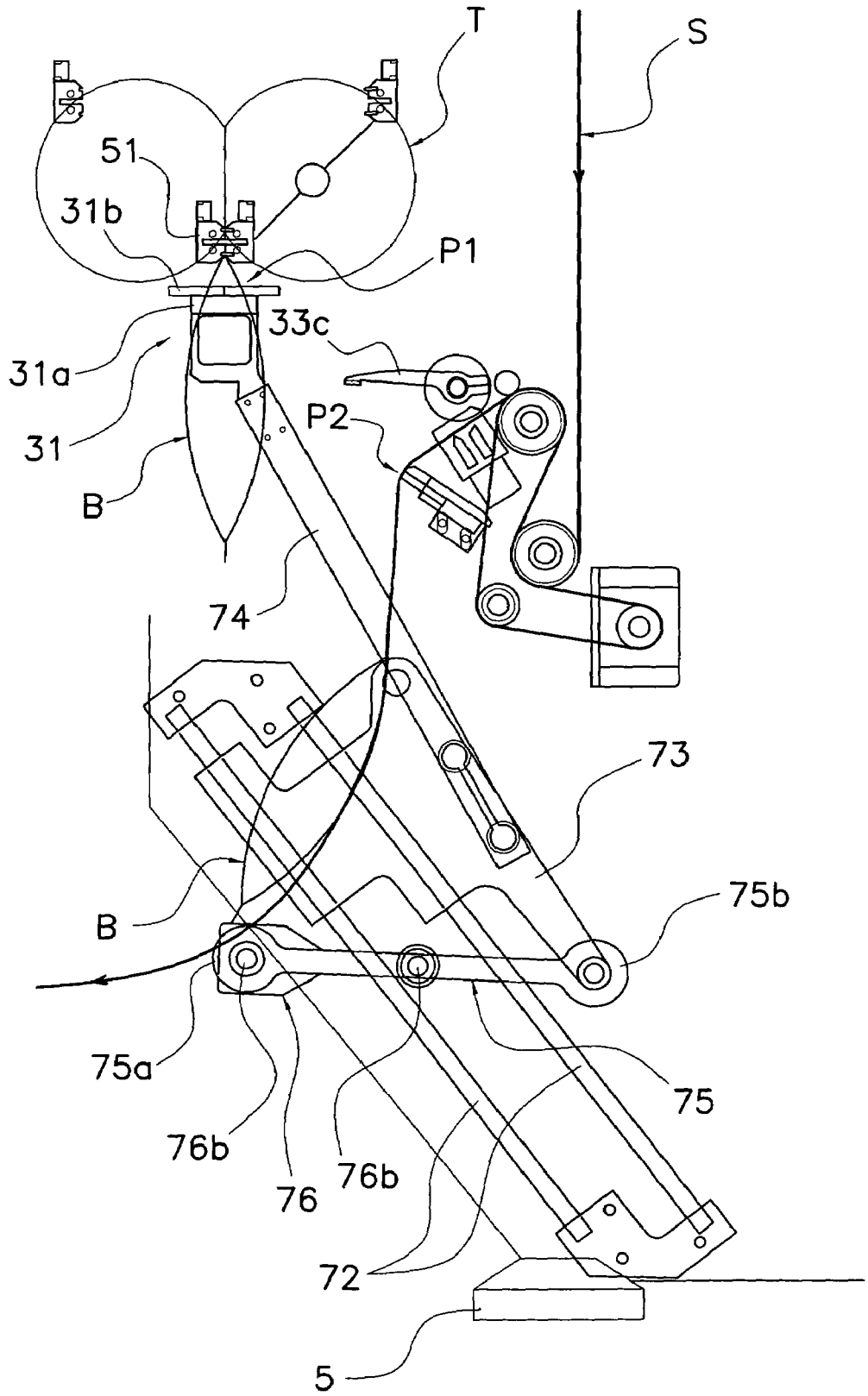
FIG. 9 is a side schematic view that shows one state of the strip mounting unit and the strip transport unit according to the embodiment of the present invention.

The holding mechanisms 31 grab and hold the bag B with their grasping arms 31*b* (refer to FIG. 6) at a holding point P1 (refer to FIG. 9). The grasping arms 31*b* circle around, respectively from both the front and rear sides to grasp the upper part of the bag B on both the left and right sides of the bag B. The holding point P1 is determined based on the fixed point P11, where the sealing jaws 51 of the transverse sealing mechanism 17 release their grasp of the bag B. Like the fixed point P11, the holding point P1 is always fixed, and is set to a position lower than the fixed point P11 by at least a predetermined distance. In other words, the holding point P1 is always at the same position even if the size of the bag B or the material of the film F changes.

Figure 6:
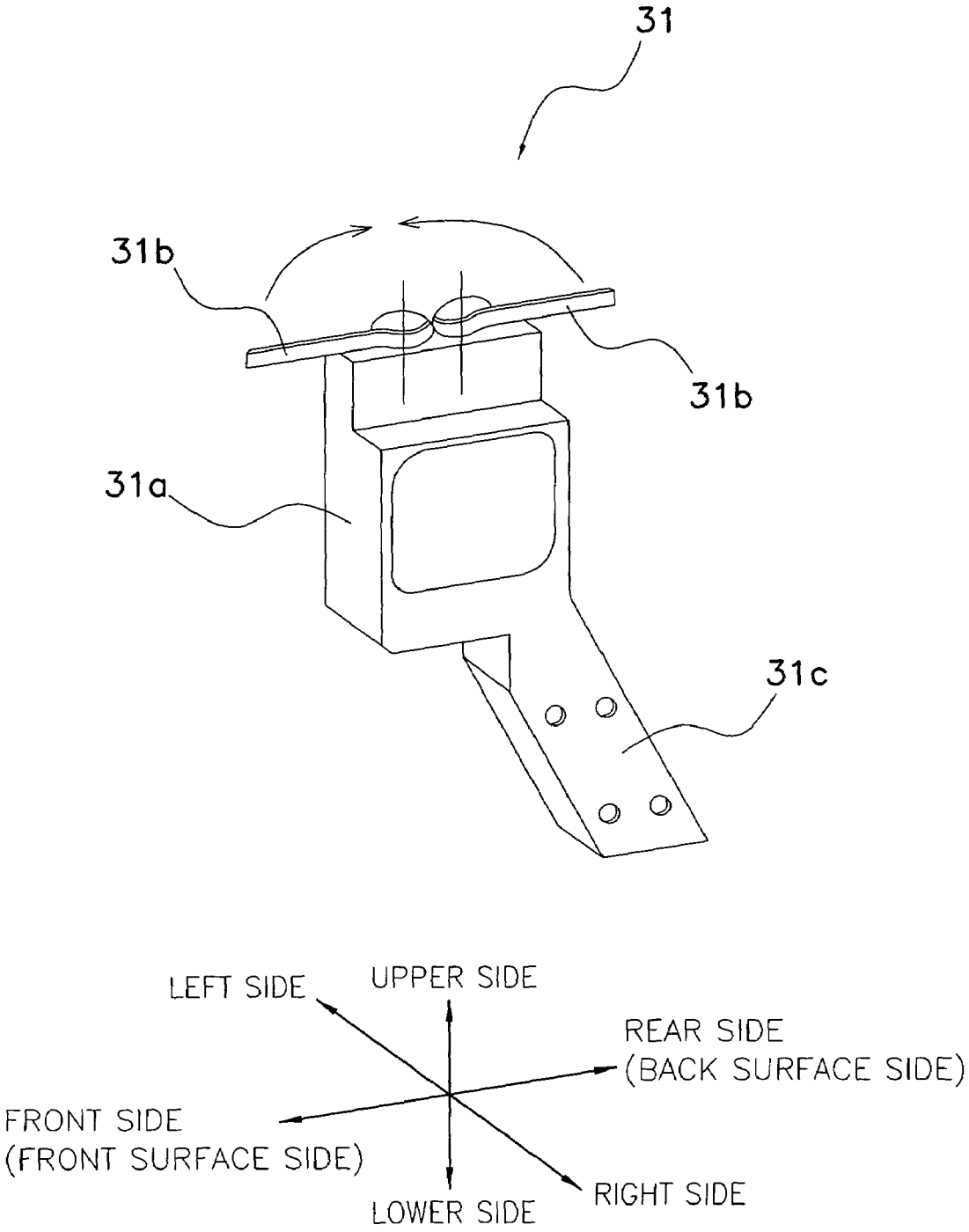
FIG. 6 is a schematic perspective view of the holding mechanism according to the embodiment of the present invention.

The holding mechanisms 31 are a pair of mechanisms that are left-right symmetrical. As shown in FIG. 6, each holding mechanism 31 includes a main body 31*a*, two grasping arms 31*b* arranged on the upper side of the main body 31*a*, a holding air cylinder (not shown) that is built into the main body 31*a*, and a fixed part 31*c* that is fixed to the transfer mechanism 32 (to be explained later). Since air cylinders are conventional part that are well know in the art, the structure of the holding air cylinder will not be discussed or illustrated in detail herein. The grasping arms 31*b* are supported by the main body 31*a* so that they swing about vertical rotary axes that are arranged in parallel at the front and rear sides. High-pressure air is supplied from a high-pressure air supply unit (not shown) via an open-close valve to the holding air cylinder, which is built into the main body 31*a*. When the holding air cylinder operates, the two grasping arms 31*b* swing in the directions of the arrows shown by the dotted line in FIG. 6, and reach a state in which the tips of the grasping arms 31*b* grab the side parts of the bag B from both the front and rear sides. The two holding mechanisms 31, one arranged on the left side and the other on the right side, are controlled with the same timing so that a total of four grasping arms 31*b* simultaneously grab the side parts of both the left and right sides of the bag B.

Transfer Mechanism 32

The transfer mechanism 32 moves the holding mechanisms 31 so that the bag B is transferred from the above-mentioned holding point P1 to a fixing point P2 (refer to FIG. 4 and FIG. 9) discussed later. In other words, the transfer mechanism 32 transfers the bag B from the holding point P1 to the fixing point P2 by moving the holding mechanisms 31 that hold the bag B. Thereby, the transfer mechanism 32 transfers the bag B to a position in which the bag B mounted to the strip S (refer to the upper bag B in FIG. 4) does not interfere with the transverse sealing mechanism 17 or the bag B to be subsequently discharged downward from the transverse sealing mechanism 17 (refer to the upper bag B in FIG. 9).

If the bag B that is being discharged downward from the transverse sealing mechanism 17 interferes with the bag B that has already been mounted to the strip S, the transverse sealing operation in the bag manufacturing unit 10 (transverse sealing mechanism 17) will become unstable. To avoid such interference, the holding point P1 and the fixing point P2 are herein offset in the front-rear direction. Specifically, the holding point P1 and the fixing point P2 are offset in the front-rear direction by at least a predetermined distance, taking into consideration factors such as the maximum thickness of the bag being handled (dimension of the bag in the front-rear direction), and the position of the bag B during mounting. Thus, a bag that will be mounted to the strip will not interfere with the next bag that will be discharged from the bag manufacturing unit 10.

The transfer mechanism 32 principally includes rails 72 whose upper and lower ends are fixedly held by fixed members 71, sliding members 73 that are movable along the rails 72, supporting members 74 that are fixedly coupled to the sliding members 73, linking members 75, rotary members 76, pulleys 66–70, belts 66*a*–69*a*, and rotary shafts 76*a*.

The fixed members 71 (omitted in FIG. 5) are, as shown in FIG. 4, fixedly supported by a pair of sidewall plates 30*a* on the left and right sides that are fixedly supported by the frame 6. The fixed members 71 are also fixedly attached to predetermined positions so that the upper and lower parts of the rails 72 do not move.

From a side view, the rails 72 are inclined from the frontward upper side to the rearward lower side, and support the sliding members 73 via linear bushings.

The sliding members 73 are mechanically linked to the movement of the sealing jaws 51 of the transverse sealing mechanism 17 (discussed later), and repetitively perform a reciprocating motion diagonally along the rails 72, as viewed from the side. The sliding members 73 are a pair of left and right members, and linking rods 79*a*, 79*b*, are arranged across the space between the sliding members 73.

The supporting members 74 are fixedly coupled to the sliding members 73 via the linking rods 79*a*, 79*b*. The supporting members 74 are a pair of left and right members that extend diagonally upward and frontward. The fixed part 31*c* of each holding mechanism 31 is fixedly attached to the upper end 74*a* of the respective supporting member 74. Accordingly, the sliding members 73, supporting members 74, and holding mechanisms 31 repetitively move diagonally together in the same manner (upward and downward, and frontward and rearward).

An end 75*b* of each linking member 75 is pivotably pin-supported to a lower end 73*a* of a sliding member 73. The other end 75*a* of each linking member 75 is pivotably pin-supported to a rotary end part 76*b* of a rotary member 76. When the rotary members 76 rotate in response to rotation of the rotary shafts 76*a*, which are fixedly supported at the rotational center, the linking members 75 take on a position as shown in FIG. 4, and then one as shown in FIG. 9. Accordingly, the sliding members 73 are pulled diagonally downward and diagonally upward.

Figure 5:
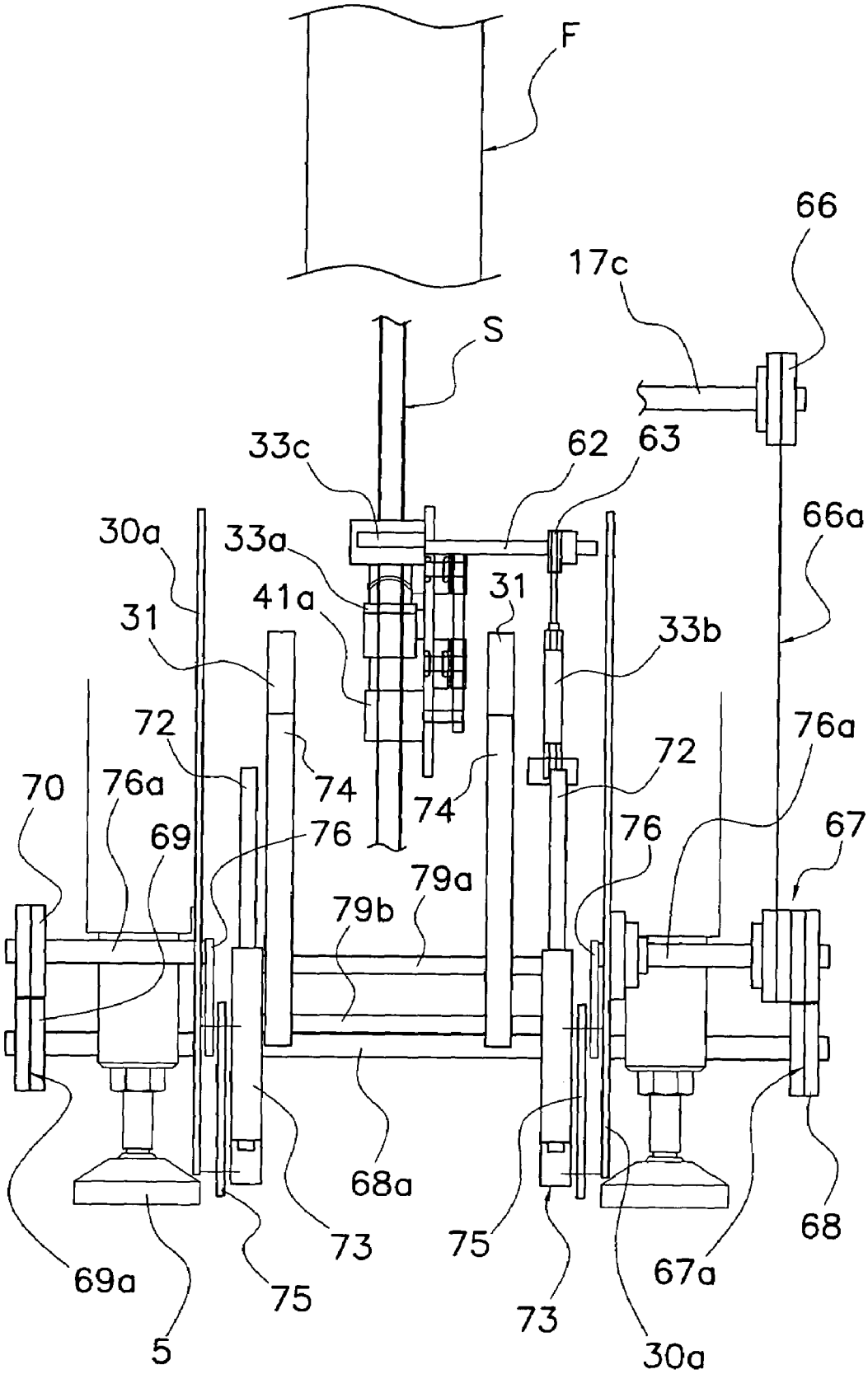
FIG. 5 is a schematic front view of the strip mounting unit and the strip transport unit according to the embodiment of the present invention.
Figure 7:
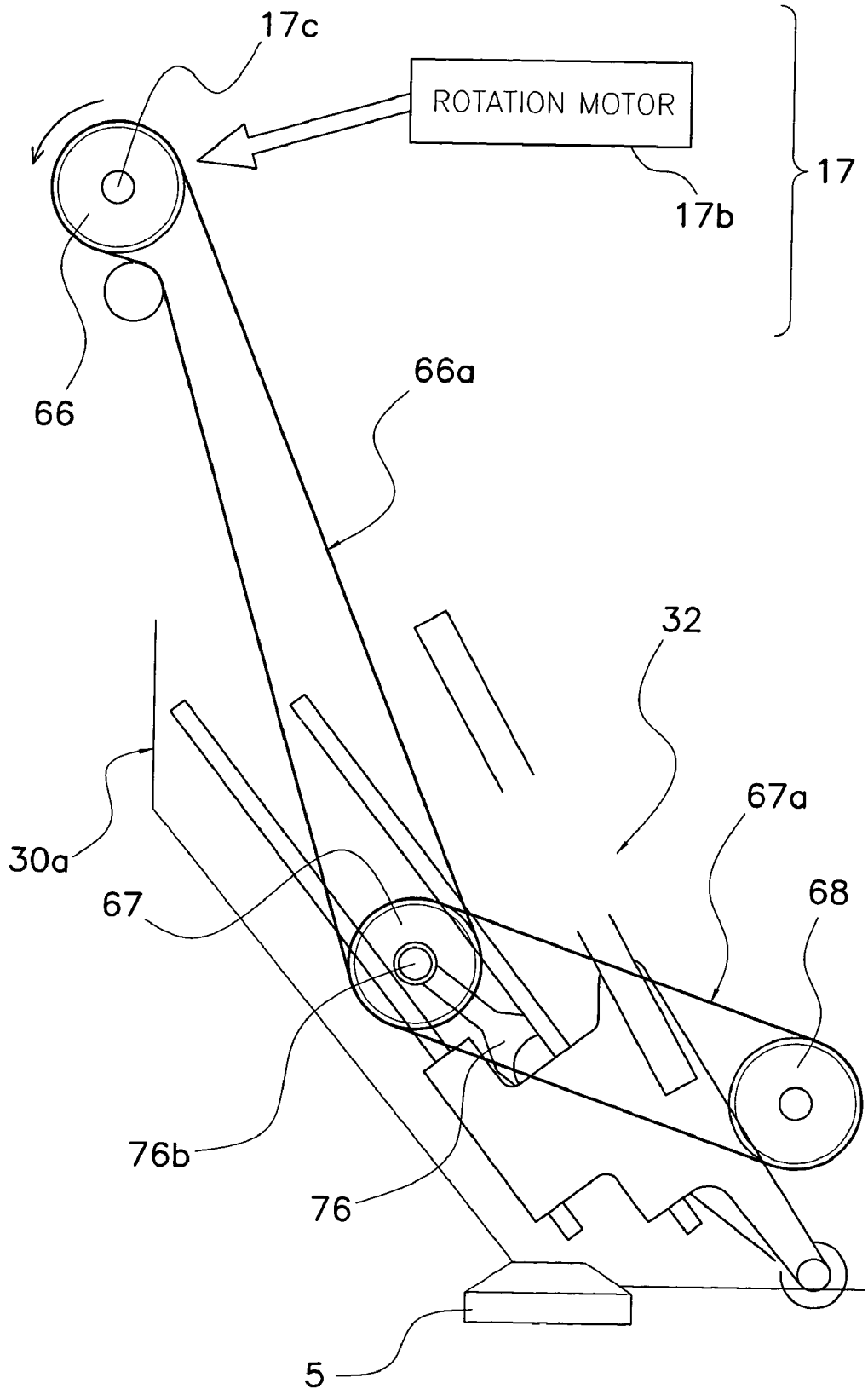
FIG. 7 shows the motive force transmission pathway of the transfer mechanism according to the embodiment of the present invention.

The left and right rotary shafts 76*a*, which rotate the pair of rotary members 76 (left and right), are rotated respectively by the rotation of pulleys 67, 70. As shown in FIG. 5 and FIG. 7, a pulley 67 is linked to the rotation of a pulley 66 via a belt 66*a*, and thereby rotates. The pulley 66 is fixedly coupled to the shaft 17*c*, which rotates the sealing jaws 51 of the transverse sealing mechanism 17. Thus, the pulley 66 rotates by the motive force of the rotation motor 17*a* of the transverse sealing mechanism 17, which rotates the shaft 17*c* (refer to FIG. 11). In other words, the pulley 67, which is fixedly coupled to the right-side rotary shaft 76*a*, rotates by the motive force of the rotation motor 17*a* of the transverse sealing mechanism 17. In addition, a pulley 70, which is fixedly coupled to the left-side rotary shaft 76*a*, is also linked to the pulley 67 via pulleys 68, 69, belts 67*a*, 69*a*, and a linking shaft 68*a*, and thereby rotates. Accordingly, the left and right rotary shafts 76*a*, which rotate the rotary members 76 and diagonally move the sliding members 73, rotate by the motive force of the rotation motor 17*a* of the transverse sealing mechanism 17, and are mechanically linked to the movement of the sealing jaws 51.

As a result of the above configuration, in the transfer mechanism 32, the holding mechanisms 31 come to a point below the sealing jaws 51 immediately before the sealing jaws 51 of the transverse sealing mechanism 17 release the manufactured bag B, as shown in FIG. 9. Also, the holding mechanisms 31 come to the vicinity of the fixing mechanism 33, as shown in FIG. 4, while the next bag B is being manufactured.

Fixing Mechanism 33

Figure 8:
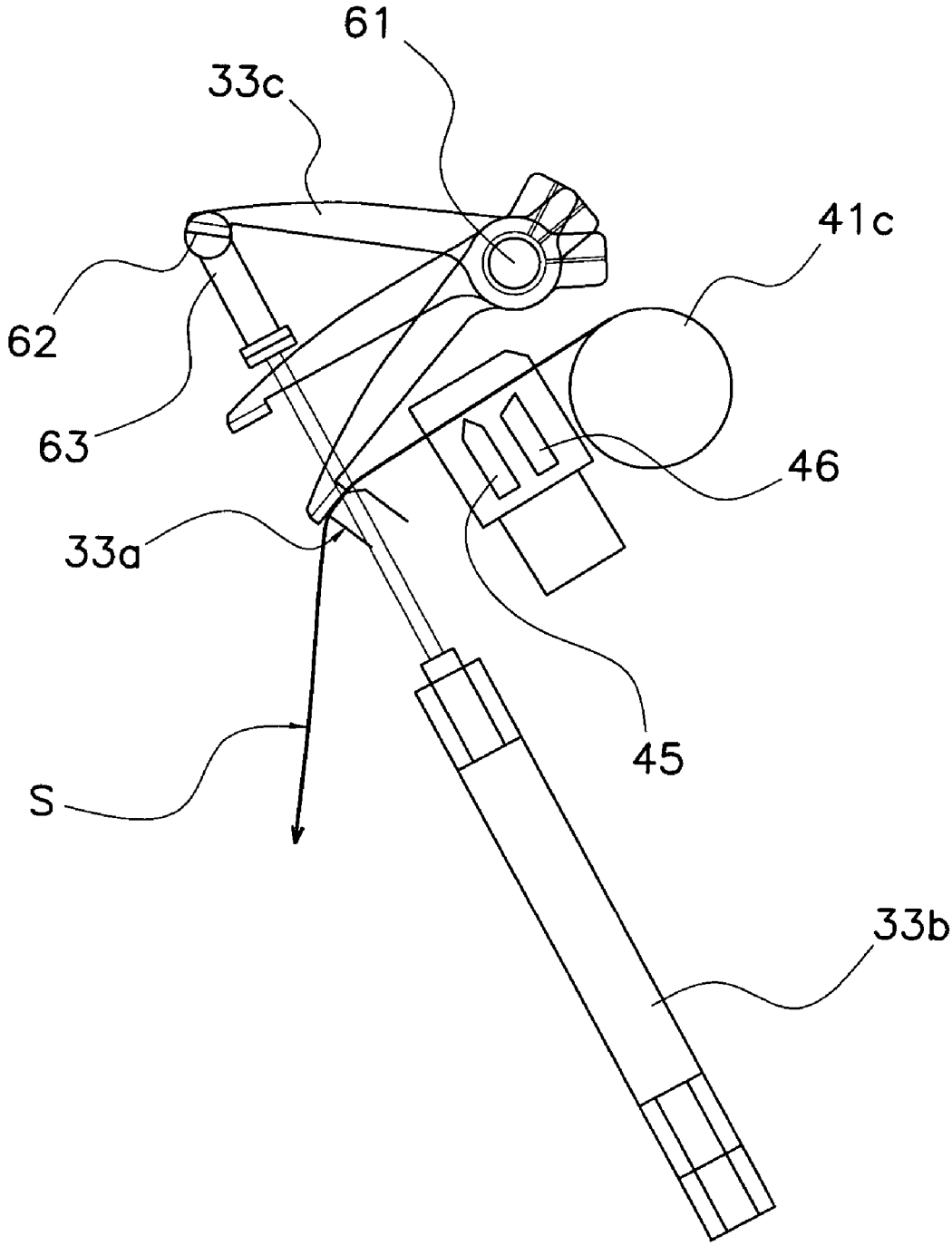
FIG. 8 shows the structure related to the drive of the pressing body of the fixing mechanism according to the embodiment of the present invention.

The fixing mechanism 33 welds the bag B to the strip S at the fixing point P2, which is lower and rearward of the holding point P1. As shown in FIG. 5 and FIG. 8, the fixing mechanism 33 principally includes a heater 33*a*, a pushing cylinder 33*b*, and a pressing body 33*c*. The heater 33*a* is a normally-energized heater with a maximum temperature of approximately 200° C. High-pressure air is supplied to the pushing cylinder 33*b* from the abovementioned high-pressure air supply unit via an open-close valve. A head 63 can be raised diagonally by operating the pushing cylinder 33*b*. The head 63 supports a tip part of the pressing body 33*c* via a linking member 62. Accordingly, the reciprocating motion of the head 63 of the pushing cylinder 33*b* is converted to the swinging motion of the pressing body 33*c*. The rear end part of the pressing body 33*c* is pivotably pin supported to a fixed shaft 61, and swings up to a predetermined angle so that the tip part of the pressing body 33*c* contacts and separates apart from the heater 33*a* (partially shown in FIG. 8).

Although the bag B is not shown in FIG. 8, in the state where the strip S and the transversely-sealed upper end of the bag B are present between the heater 33*a* and the pressing body 33*c* (refer to FIG. 4), the fixing mechanism 33, based on a command from the control unit 90, clamps the strip S and the bag B between the pressing body 33*c* and the heater 33*a*. Therein, the configuration is such that, when the air from inside the pushing cylinder 33*b* is removed, the pressing body 33*c* applies pressure toward the heater 33*a* and presses the upper end of the bag B to the strip S for at least approximately 200 ms. Thereby, the upper end of the bag B is welded to the strip S.

Strip Roll Holding Unit 42

The strip roll holding unit 42 holds a strip roll 42*a* for supplying the strip S in the space on the upper side of the heater 33*a* of the fixing mechanism 33. The strip S is wound around the strip roll 42*a*.

In addition, a strip remaining amount sensor 43 (refer to FIG. 11) is arranged in the vicinity of the strip roll holding unit 42 in order to detect the amount of strip S remaining on the strip roll 42*a*. The strip remaining amount sensor 43 is a photoelectric sensor that detects whether any strip S remains on the strip roll 42*a* by detecting the presence of the strip S reeled out from the strip roll 42*a*. The detection results of the strip remaining amount sensor 43 are sent to the control unit 90.

Strip Transport Unit 41

The strip transport unit 41 transports the strip S reeled out from the strip roll 42*a* to the fixing mechanism 33. The strip transport unit 41 has a transport motor 41*a*, a drive belt 41*b*, drive rollers 41*c*, 41*d*, and a plurality of rollers. The drive section, which includes the transport motor 41*a*, the drive belt 41*b*, and the drive rollers 41*c*, 41*d*, is provided in the vicinity of the fixing mechanism 33. The rotation of the rotary shaft of the transport motor 41*a* is transmitted to the drive rollers 41*c*, 41*d* via the drive belt 41*b*, whereupon the strip S looped around the drive rollers 41*c*, 41*d* is transported above the heater 33*a* of the fixing mechanism 33. Attendant thereto, the rotation of the strip roll 42*a*, which reels out the strip S to the drive rollers 41*c*, 41*d* via a plurality of rollers, successively reels out the reeled strip S.

The transport motor 41*a* is a servomotor for transporting the strip S. The control unit 90 (discussed later) determines the feed amount by reading the pulses of the transport motor 41*a*, and controls the feed amount of the strip S.

Figure 10:
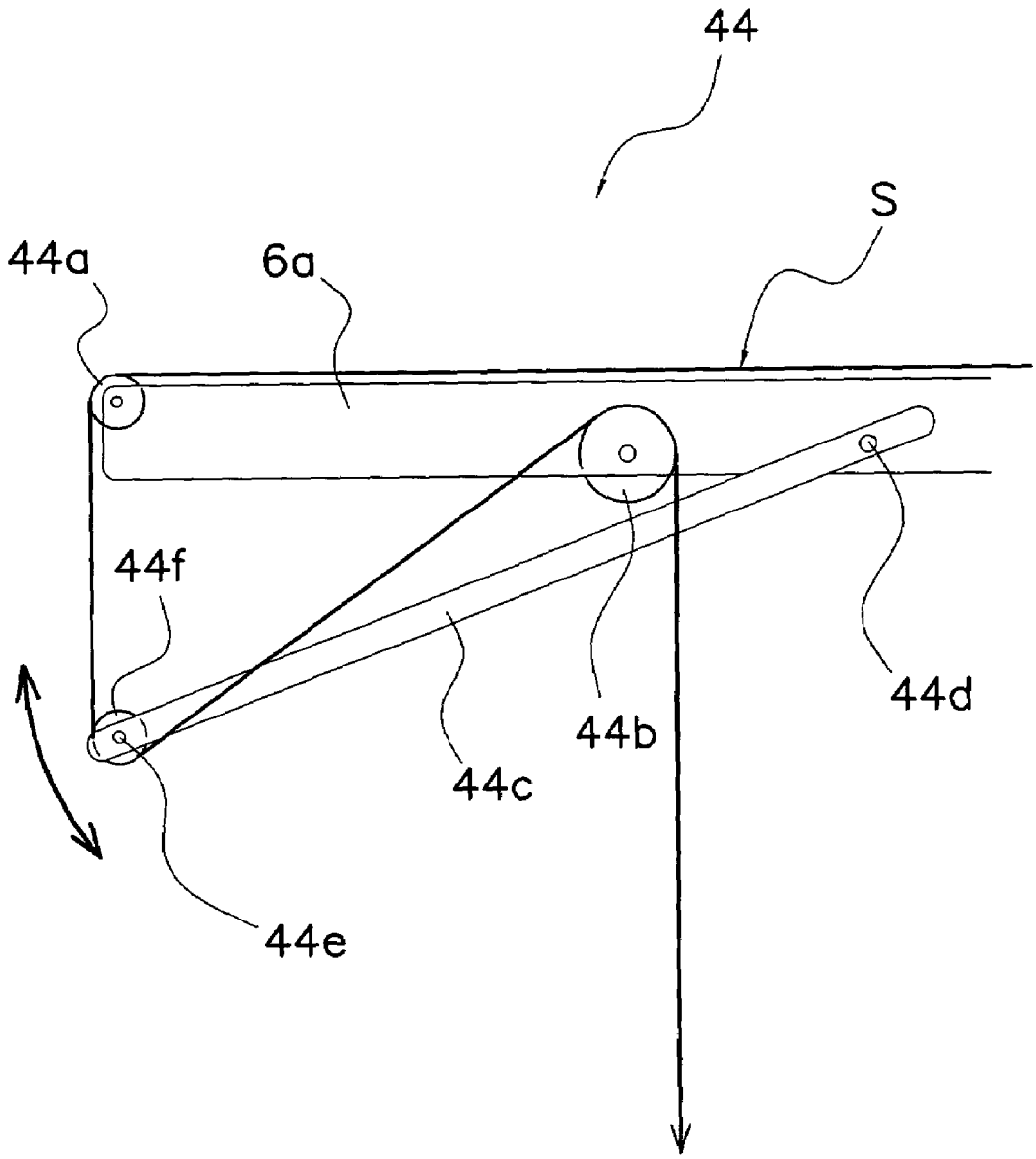
FIG. 10 is a side view of the tension control mechanism according to the embodiment of the present invention.

In addition, a tension control mechanism 44 shown in FIG. 10 controls the tension of the strip S reeled out from the strip roll 42*a* and transported to the fixing mechanism 33. As shown in FIG. 10, the tension control mechanism 44 has two rollers 44*a*, 44*b*, which are rotatably supported by a fixed member 6*a* fixedly coupled to the frame 6; an arm 44*c*, which is rotatably supported by the fixed member 6*a* at a rear end part 44*d* and extends frontward and downward; and a roller 44*f*, which is axially supported by a tip part 44*e* of the arm 44*c*. By sequentially looping the strip S across these three rollers 44*a*, 44*f*, 44*b*, the arm 44*c* and the roller 44*f* pull the strip S with a predetermined force, and the tension of the strip S is maintained in a predetermined range. Thereby, slackening and meandering of the strip S is controlled.

Figure 14:
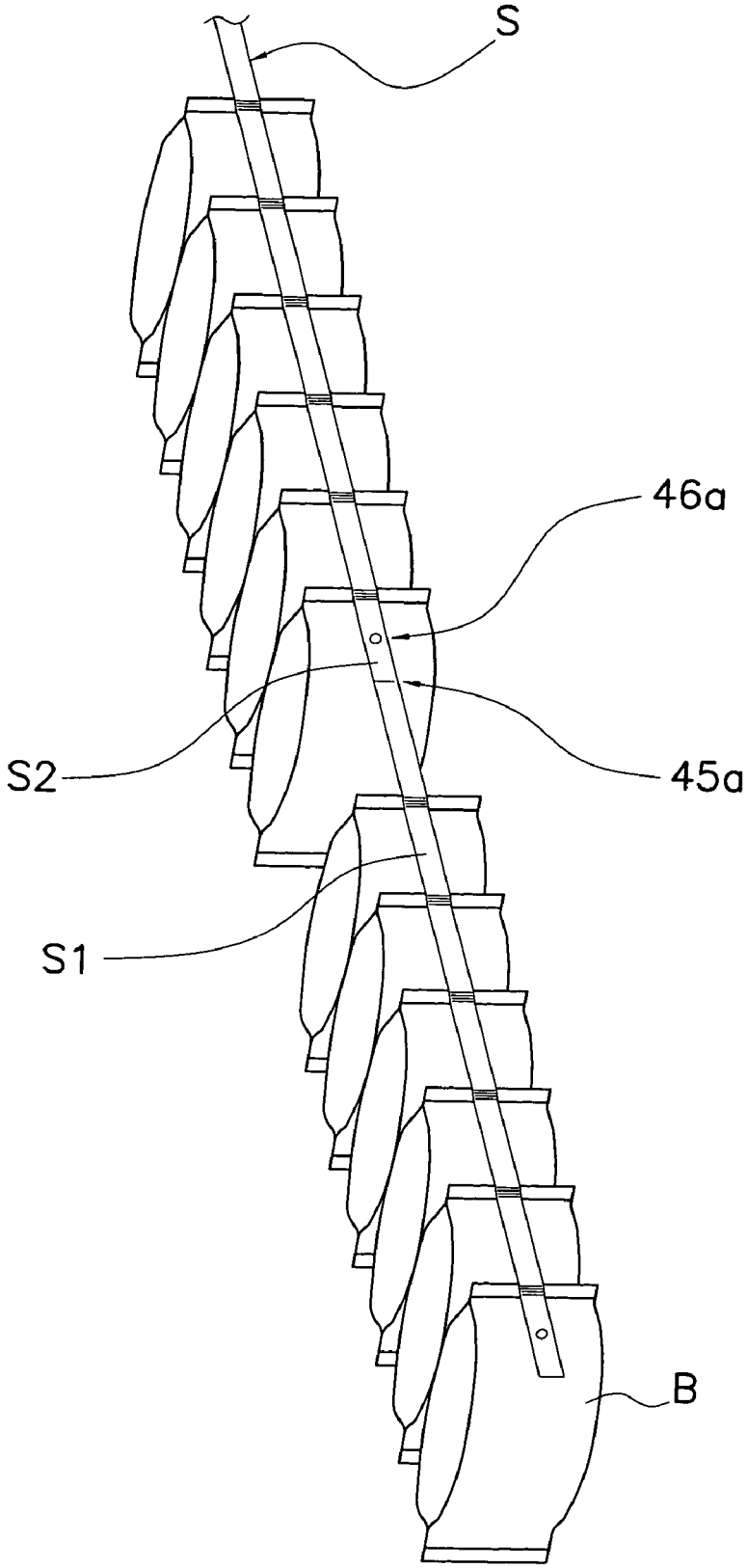
FIG. 14 is a perspective view that shows the state of bags mounted to a strip according to the embodiment of the present invention.

Furthermore, a cutter 45 and a punch 46 (refer to FIG. 8) are provided between a drive roller 41*c* of the strip transport unit 41 and the heater 33*a* of the fixing mechanism 33 so that slits and holes can be formed in the strip S fed out from the strip transport unit 41 to the fixing mechanism 33. The cutter 45 can form a slit 45*a* in the strip S, as shown in FIG. 14. The punch 46 can form a hole 46*a* in the strip S, as shown in FIG. 14. The cutter 45 and the punch 46 are arranged on the upstream side of the heater 33*a* and the pressing body 33*c* of the fixing mechanism 33 in the strip S transport direction. The cutters and punches are conventional components that are well known in the art. Therefore, these structures will not be discussed or illustrated in detail herein.

Transport Conveyor 85

The transport conveyor 85 (an example of strip-attached-bag discharge unit) shown in FIG. 1 discharges toward the front side a series of bags B, whose upper ends have been welded to the strip S by the fixing mechanism 33 as shown in FIG. 14. As clearly shown in FIG. 1, there is an open space below the bag manufacturing unit 10, on the front side relative to the fixed point P11, where the bags are released. The transport conveyor 85 transports bags that are mounted to the strip toward the front side. As shown in FIG. 11, a transport motor 85*a* operates the transport conveyor 85 continuously at a fixed speed in this embodiment. However, the transport motor 85*a* can also operate the transport conveyor 85 intermittently.

Control Unit 90

The control unit 90 preferably includes a microcomputer with a control program that controls various components such as motors, the air cylinder, and the heater, based on settings input via a touch panel-type display 91 by an operator of the bag manufacturing and packaging apparatus 1 and the like. As shown in FIG. 11, the control unit 90 controls the roller drive motor of the pull-down belt mechanism 14, the heater of the longitudinal sealing mechanism 15, the rotation motor 17*a* of the transverse sealing mechanism 17, the shaft moving motor 17*b* and the built-in cutter, the holding air cylinders of the holding mechanisms 31, the heater 33*a* and the pushing cylinder 33*b* of the fixing mechanism 33, the transport motor 41*a* of the strip transport unit 41, the cutter 45, the punch 46, the transport motor 85*a* of the transport conveyor 85, and the like. The control unit 90 is operatively coupled to these device in a conventional manner. The control unit 90 is capable of selectively controlling any of the abovementioned devices in accordance with the control program. In addition, the control unit 90 inputs the detection results from the film remaining amount sensor 23, the strip remaining amount sensor 43, and the like. The control unit 90 can also include other conventional components such as an input interface circuit, an output interface circuit, and storage devices such as a ROM (Read Only Memory) device and a RAM (Random Access Memory) device. The internal ROM of the control unit 90 stores settings for various operations.

The operator and the like inputs via the touch panel-type display 91 setting items such as the size of bags B to be manufactured, the number of bags B to be manufactured per unit of time, whether to mount the bags B to the strip S, the quantity of bags B per group mounted to the strip S, the mounting pitch of the bags B with respect to the strip S, and the distance between groups of bags B.

It will be apparent to those skilled in the art from this disclosure that the precise structure and algorithms for control unit 90 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

The following explains the control performed by the control unit 90 relating to the mounting to the strip S of the bags B that have been manufactured by the bag manufacturing unit 10 and discharged downward from the transverse sealing mechanism 17.

Control for Mounting the Bag B to the Strip S

The strip mounting unit 30 mounts the bag B to the strip S by the three operations of: the holding operation in which the holding mechanisms 31 hold the bag B; the transferring operation in which the transfer mechanism 32 transfers the bag B; and the fixing operation performed by the fixing mechanism 33

In the holding operation of the bag B by the holding mechanisms 31, the control unit 90 operates the holding air cylinder immediately before the pair of sealing jaws 51 releases its grasp of the bag B, and the four grasping arms 31*b* grab both the left and right sides of the bag B.

The transfer operation of the bag B by the transfer mechanism 32 is performed mechanically by the motive force of the rotation motor 17*a* of the transverse sealing mechanism 17, as discussed above.

In the fixing operation performed by the fixing mechanism 33, the pressing body 33*c* is pressed against the normally-energized heater 33*a* by controlling the pushing cylinder 33*b*. This creates a state wherein the strip S and the upper end of the bag B are grasped between the pressing body 33*c* and the heater 33*a*, and the heat from the heater 33*a* and the pressure from the pressing body 33*c* weld the bag B to the strip S. The timing of this pressing action (welding timing) coincides with the timing by which the transfer mechanism 32 transfers the bag B to the fixing point P2. In addition, the control unit 90 adjusts the frequency of fixing the bags B to the strip S so that it falls within an appropriate range by adjusting the temperature of the heater 33*a*, the pressing force of the pressing body 33*c*, and the length of time for which the pressing body 33*c* is pressed toward the heater 33*a*.

Furthermore, among the three operations mentioned above, the holding operation and the fixing operation can be performed regardless of the motion of the bag manufacturing unit 10, and the transfer operation is mechanically linked to the movement of the transverse sealing mechanism 17 of the bag manufacturing unit 10.

Strip Transport Control, and Cutter and Punch Control

The strip transport unit 41 controls the transport motor 41*a* based on: the number of bags B to be manufactured per unit of time as set by the input of the operator and the like; the quantity of bags B in one group to be mounted to the strip S; the mounting pitch of the bags B with respect to the strip S; the distance between groups of bags B; and the like. As discussed above, the control unit 90 ascertains the feed quantity by reading the pulses of the transport motor 41*a*, and thereby controls the feed quantity of the strip S. In addition, in concert with the transport of the strip S, the control unit 90 controls the operation of the cutter 45 inserting slits 45*a* in the strip S and the operation of the punch 46 creating holes 46*a* in the strip S.

The quantity of one group of bags B mounted to the strip S is the quantity that constitutes the display unit when displayed in a retail store, which is, for example, six bags as shown in the example in FIG. 14.

The pitch at which the bags B are mounted to the strip S is the distance between adjacent bags B in one group of bags B, and is equivalent to the distance by which the strip S advances from the fixing of a bag B to the strip S until fixing of the next bag B to the strip S (transport pitch, shown as a short span part S1 in FIG. 14). To make the transport pitch fixed, the control unit 90 controls the transport motor 41*a* so that the strip S is intermittently transported in a methodical manner.

The distance between groups of bags B is equivalent to the distance that the strip S advances from when the last bag B of a group of bags B is fixed to the strip S until the first bag B of the next group of bags B is fixed to the strip S. Ordinarily, this distance is set longer than the abovementioned transport pitch between adjacent bags B in the same group. The cutter 45 forms the slit 45*a* and the punch 46 forms the hole 46*a* in a long span part S2 of the strip S between one group of bags B and another group of bags B (refer to FIG. 14). Furthermore, the cutter 45 does not ordinarily form a slit, nor does the punch 46 ordinarily form a hole in the short span part S1 of the strip S, which is formed by the regular transport pitch.

By controlling the transport of the strip S and controlling the cutter 45 and the punch 46 in this manner, the strip S to which the bags B have been mounted take on a state as shown in, for example, FIG. 14. At shipping destinations like retail shops, the strip S is cut using the slit 45*a* to divide the strip S into groups of bags B (six bags per group), and the hole 46*a* can be used to hang each strip S, to which a group of bags B is attached, from a hook and the like in the store.

Mount Operation in the Event of a Weight Failure, and Halt Control of the Strip Transport Operation If a weight-failure signal is received from the weigher 2, the control unit 90 continues operation of the bag manufacturing unit 10 in order to ensure high-speed performance. However, the manufactured bag that was filled with the potato chips C that had the weight failure is not mounted to the strip S, and is instead sorted and rejected. At this time, a portion of the mounting operation, and the strip transport operation are temporarily suspended.

Within the mounting operation, the transport operation that is mechanically linked to the movement of the transverse sealing mechanism 17 of the bag manufacturing unit 10 is continuously performed, but the holding operation and the fixing operation are no longer performed. In other words, for the bag B that generated a weight failure, the transfer mechanism 32 transports the holding mechanisms 31 to the holding point P1, but the holding mechanisms 31 do not operate and therefore do not hold the bag B. Consequently, the bag B that generated a weight failure is manufactured and then discharged downward from the transverse sealing mechanism 17, and then dropped directly downward. This bag B is sorted either leftward or rightward by a sorting apparatus (not shown in Figures). The sorting apparatus transports the bag B leftward or rightward by applying a lateral force to the bag B by means of air or a sorting member, and thereby prevents the bag B from being loaded onto the transport conveyor 85.

In addition, since the holding mechanisms 31 do not hold the bag B that generated a weight failure, the fixing operation of the fixing mechanism 33 is also halted, such that unneeded heat and pressure are not applied to the strip S. Furthermore, the intermittent transport of the strip S by the strip transport unit 41 is also halted at the time when the bag B that generated a weight failure arrives so that the mounting pitch of the bags B does not shift.

Characteristics of the Bag Manufacturing and Packaging Apparatus 1

(1)

In the bag manufacturing and packaging apparatus 1, a bag B manufactured by the bag manufacturing unit 10 is mounted to the strip S in the strip mounting unit 30. Thus, in the bag manufacturing and packaging apparatus 1, which is provided with a strip mounting unit 30 separate from the bag manufacturing unit 10, the motive force from the rotation motor 17*a*, which is the power source for transversely sealing the bags B, provides the power for the transfer operation by the transfer mechanism 32, which is one of the operations of the mounting operation of the strip mounting unit 30. Consequently, the transfer operation performed by the transfer mechanism 32 is mechanically linked to the motion of the bag manufacturing unit 10 (transverse sealing mechanism 17). As a result, the risk that the transfer operation will become offset with respect to the motion of the bag manufacturing unit 10 due to a control error and the like is virtually eliminated, and errors and failures in mounting the bags B to the strip S are reduced.

(2)

In the bag manufacturing and packaging apparatus 1, the transfer operation performed by the transfer mechanism 32, which is mechanically linked to the motion of the transverse sealing mechanism 17, which is located at the most downstream point of the bag manufacturing unit 10, transfers the manufactured bag B diagonally rearward while transferring it downward, rather than in the horizontal direction. Thus, because the transfer direction of the bag B is diagonal, the movement of the bag B is smooth in the series of operations from the manufacturing of the bag B to the mounting of the bag B to the strip S in the fixing mechanism 33 of the strip mounting unit 30. Consequently, even if the bags B are manufactured at a high speed in the bag manufacturing unit 10 (e.g., using a setting so that the bags B are manufactured at 120 to 150 bags per minute), few problems arise in mounting the bags B, in the same manner as where manufactured bags are transferred directly downward and then mounted to a strip.

In addition, the bags B manufactured by the bag manufacturing unit 10 are transferred diagonally downward instead of directly downward. Consequently, even if the next bag B is manufactured and discharged downward from the transverse sealing mechanism 17 of the bag manufacturing unit 10, it does not interfere with the previous bag B. In other words, the previous bag B manufactured and fixed to the strip S does not interfere with the next bag B that is being manufactured and discharged downward from the transverse sealing mechanism 17, because the bag B is shifted in the front-rear direction (thickness direction of the bag B) once being manufacture. Also, the bag B is fixed to the strip S at the fixing point P2, which is planarly shifted from the point P11, where the manufacture of bags B is completed.

Further, because the configuration is such that interference is avoided by transferring the bags B diagonally downward instead of directly downward, it is possible to reduce the transfer distance along the vertical direction of the bag B by the transfer operation of the transfer mechanism 32. More specifically, to avoid interference while transferring the bag B directly downward, the transfer direction must be at least as long as the bag B in the vertical direction (height direction). However, because the bag B is transferred herein diagonally downward, the distance in the vertical direction between the point P11 (where manufacturing of the bag B is completed), the holding point P1, and the fixing point P2 can be made shorter than the length of the bag B in the vertical direction. Thereby, the overall height dimension of the bag manufacturing and packaging apparatus 1 can be reduced.

Furthermore, because a configuration is adopted wherein the transfer mechanism 32 transfers the bag B diagonally downward without transferring it horizontally, it is also possible to avoid interference between the holding mechanisms 31, which grab the bag B, and the sealing jaws 51 (and ancillary objects) of the transverse sealing mechanism 17, which define an approximately D-shaped trajectory T.

(3)

The bag manufacturing and packaging apparatus 1 is provided with a power source (holding cylinder and the pushing cylinder 33*b*), separate from the power source of the bag manufacturing unit 10, for the holding operation performed by the holding mechanisms 31 and the fixing operation performed by the fixing mechanism 33. In other words, the control unit 90 is able to temporarily unlink the motion of the bag manufacturing unit 10 from the holding operation and the fixing operation in the strip mounting unit 30.

Further, if the control unit 90 receives a weight-failure signal from the weigher 2, operation of the bag manufacturing unit 10 is continued in order to ensure high-speed performance. However, the control unit 90 performs control so that the holding operation and the fixing operation to the strip S is not performed for the manufactured bag B that was filled with the potato chips C that generated a weight failure. Thereby, the unfortunate mounting to the strip S of the bag B that generated a weight failure is prevented.

(4)

In the bag manufacturing and packaging apparatus 1 as shown in FIG. 14, a long span part S2 is formed in the strip S between one group of bags B and the next group of bags B, each group having an ordinary transfer pitch S1 between their bags. The cutter 45 forms a slit 45*a* in the long span part S2. If the cutter 45 were to completely cut, as opposed to form a slit on, the strip S, a problem would arise in the handling of the plurality of bags B mounted to the strip S. However, because only a slit 45*a* is formed herein and the strip S is not completely cut, the bags B mounted to the strip S can be continuously handled in the next process.

In addition, because the punch 46 can form a hole 46*a* in the strip S, it is easy to hang the strip S whereon the bags B are mounted, at the destination where the bags B mounted to the strip S are to be shipped.

(5)

The heater 33*a* and the pressing body 33*c* of the fixing mechanism 33 mount the bags B to the strip S that was transported by the strip transport unit 41. The strip S on which bags B are mounted is subsequently sent to the next process by the transport conveyor 85. Accordingly, if a cutter and a punch were arranged on the downstream side of the fixing mechanism 33, a separate mechanism would be needed on the downstream side of the cutter and the punch in order to hold the strip S when the cutter forms a slit.

Taking this into consideration, the cutter 45 and the punch 46 herein are arranged on the upstream side of the fixing mechanism 33, and the drive rollers 41*c*, 41*d* and the like of the strip transport unit 41 serve the role of holding the strip S when the cutter 45 cuts the strip S.

(6)

In the bag manufacturing and packaging apparatus 1, the pair of sealing jaws 51 of the transverse sealing mechanism 17 in the bag manufacturing unit 10 apply pressure and heat to the upper and lower ends of the bag B while the pair of sealing jaws 51 moves downward. Thereby, the bag B whose ends are transversely sealed is grabbed and moved by the holding mechanisms 31, which reciprocatingly move diagonally in the strip mounting unit 30.

The pair of sealing jaws 51 of the transverse sealing mechanism 17 is controlled in the transfer and holding operations of the holding mechanisms 31 so that the manufactured bag B is released at a fixed height position. Specifically, the sealing jaws 51 are controlled so that they release their grasp of the bag B at the point P11, which is a fixed point regardless of the size of the bag B or the type of film F. To accommodate this arrangement, the strip mounting unit 30 is configured so that the holding point P1, which is the point at which the holding mechanisms 31 hold the bag B, is fixed, and so that the holding mechanisms 31 move with respect to the holding point P1. Consequently, the configuration of the strip mounting unit 30, particularly the configuration of the transfer mechanism 32 and the control of the transfer mechanism 32, is simplified. Also, mismounting of a bag B to the strip S is infrequent.

In conventional bag manufacturing and packaging apparatuses (without a strip mounting function), the sealing jaws press against one another and begin the transverse sealing operation usually at a fixed point. The bag manufacturing and packaging apparatus is also controlled so that the end point of the transverse sealing operation shifts upwards or downwards if the size or other parameter of the bag changes.

Other Embodiments (A)

When a weight-failure signal is received from the weigher 2 in the abovementioned embodiment, control is performed so that the operation of the bag manufacturing unit 10 is continued in order to ensure high-speed performance, and so that the holding operation and the fixing operation to the strip S is not performed for the manufactured bag B that was filled with the potato chips C that generated a weight failure.

Although this type of control avoids the problem of mounting to the strip S a bag B that generated a weight failure, the operation of the bag manufacturing unit 10 is not stopped. Therefore, the transfer operation of the transfer mechanism 32 of the strip mounting unit 30 linked thereto continues.

If there is a risk that the transfer operation will interfere with the motion of a sorting apparatus (not shown), which sorts bags B that generated a weight failure, then it is also conceivable to adopt a configuration wherein a motive force cutoff mechanism is installed in the motive force pathway in which the motive force of the rotation motor 17*a* of the transverse sealing mechanism 17 is linked to the transfer operation in the strip mounting unit 30. In this arrangement, the motive force is cut off when the strip mounting unit 30 does not need to perform the mounting operation.

(B)

The abovementioned embodiment employs a photoelectric-type strip remaining amount sensor 43 that detects the presence of the strip S reeled out from the strip roll 42*a*. However, it is also possible to use instead other types of sensors, such as a sensor that detects an end mark affixed to the strip roll 42*a*, a sensor that detects the thickness of a predetermined portion of the strip roll 42*a*, or a sensor that detects the tension of the strip S reeled out from the strip roll 42*a*.

(C)

Figure 15:
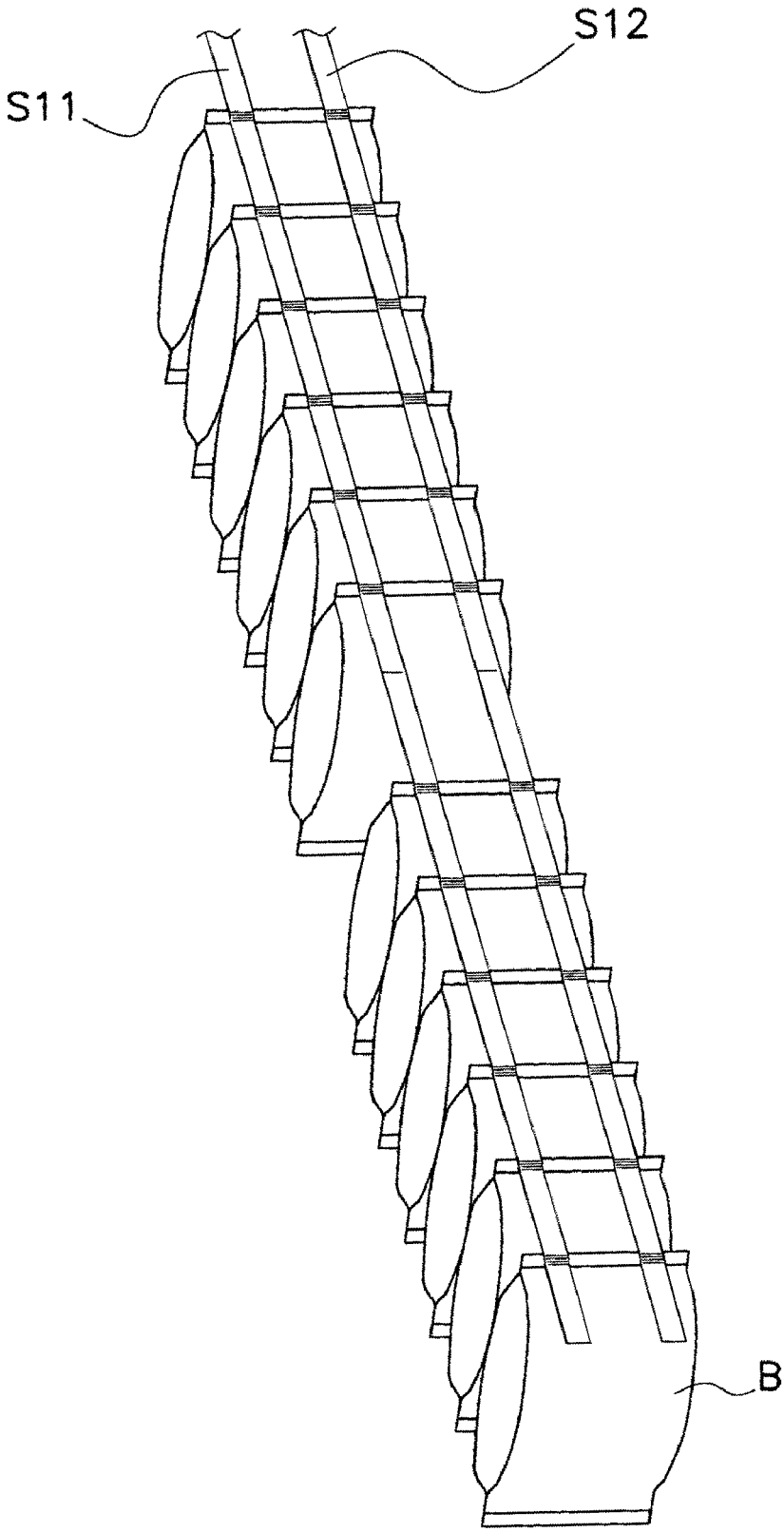
FIG. 15 is a perspective view that shows the state of bags mounted to strips in a modified example according to the embodiment of the present invention.

In the abovementioned embodiment, bags B are mounted to one strip S, and a plurality of bags B is delivered to the subsequent process in a state as shown in FIG. 14. However, as shown in FIG. 15, it is also possible to constitute the strip transport unit 41 and strip remaining amount sensor 43 so that the bags B are mounted to two strips S11, S12.

(D)

The abovementioned embodiment employs holding mechanisms 31 in which grasping arms 31*b* grab both the left and right side portions of the bag B. However, it is also possible to employ a holding mechanism that holds the bag B using a suction unit and the like instead of the grasping arms 31*b*.

Because the transfer direction of the bags is diagonal in the present invention, the bags can be moved smoothly during the sequence of operations from the manufacturing of the bags to the mounting of the bags to a strip in the mounting unit. Thereby, even if bags are manufactured in the bag manufacturing unit at a high speed, few problems arise in the mounting of bags in the mounting unit.

In addition, transferring the bags diagonally downward instead of directly downward enables the implementation of a structure wherein interference between the previous bag and the next bag can be avoided, even if bags are continuously manufactured at a high speed. This structure can be implemented while at the same time reducing the transfer distance of the bags in the transfer mechanism along the vertical direction.

In addition, in another aspect of the present invention, it is no longer necessary to introduce a complex configuration or control of the mounting unit in order to deal with changes in the position of the bag, which is the case if the position of the manufactured bag is not fixed prior to the operation of the mounting unit mounting the bag to a strip. In light of this, the release position, i.e., the position in the vertical direction at which the pair of sealing members releases its grasp of the ends of the bag, is fixed in the present invention. Thereby, the complexity of the configuration and control of the mounting unit is reduced.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Applications Nos. 2002251844 and 2002-251845. The entire disclosure of Japanese Patent Applications Nos. 2002-251844 and 2002-251845 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention is provided for illustration only, and not for the purpose of limiting the invention as defined by the appended claims and their equivalents.

What is claimed is:

1. A bag manufacturing and packaging apparatus that is arranged to output in a frontward direction bags affixed to a strip, said bag manufacturing and packaging apparatus comprising:

a bag manufacturing unit that manufactures bags filled with articles; and a mounting unit that mounts bags manufactured by said bag manufacturing unit to a strip, said mounting unit having a transfer mechanism that transfers the bags manufactured by said bag manufacturing unit in a diagonally downward and rearward direction, and a fixing mechanism that affixes the bags to the strip after said transfer mechanism transfers the bags.

2. The bag manufacturing and packaging apparatus as set forth in claim 1, wherein said bag manufacturing unit discharges manufactured bags downward; and said transfer mechanism transfers bags to a position in which a bag that will be mounted to the strip will not interfere with a next bag that will be discharged from said bag manufacturing unit.

3. The bag manufacturing and packaging apparatus as set forth in claim 1, further comprising a strip roll that reels out the strip, and a strip transport unit that transports strips reeled out from the strip roll to said fixing mechanism.

4. The bag manufacturing and packaging apparatus as set forth in claim 3, further comprising a tension control mechanism for maintaining the tension of a strip transported by said strip transport unit in a predetermined range.

5. The bag manufacturing and packaging apparatus as set forth in claim 3, wherein said strip transport unit transports a plurality of strips to said fixing mechanism; and said fixing mechanism affixes bags to at least one of the plurality of strips.

6. The bag manufacturing and packaging apparatus as set forth in claim 3, further comprising a remaining amount detecting unit that detects the amount of strips remaining in said strip roll.

7. The bag manufacturing and packaging apparatus as set forth in claim 1, wherein there is an open space below said bag manufacturing unit on a front side relative to a point where said bag manufacturing unit releases the bags downward;

said transfer mechanism transfers the bags toward a rear side; and said bag manufacturing and packaging apparatus further comprises a strip-attached-bag discharge unit that discharges bags that are mounted onto the strip by said fixing mechanism toward the front side.

8. The bag manufacturing and packaging apparatus as set forth in claim 1, further comprising a control unit that is operatively coupled to said transfer mechanism and said fixing mechanism and is configured to control said transfer mechanism such that the bags do not interfere with said sealing members while being transferred.

9. A bag manufacturing and packaging apparatus that is arranged to output in a frontward direction bags affixed to a strip, said bag manufacturing and packaging apparatus comprising:

a bag manufacturing unit that manufactures bags filled with articles, said bag manufacturing unit including a transverse sealing mechanism that seals a vertical end of a bag, said transverse sealing mechanism having a pair of sealing members that grasps the end of the bag and applies heat and pressure while moving downward to seal the end, said pair of sealing members releasing the end of the bag at a release position, said release position being fixed within said bag manufacturing and packaging apparatus without regard to a distance by which said pair of sealing members moves downward while grasping the bag; and a mounting unit having a fixing mechanism that affixes bags that are manufactured by said bag manufacturing unit to a strip at a fixing position, the fixing position being positioned downward and offset in a rearward direction relative to the release position.

10. The bag manufacturing and packaging apparatus as set forth in claim 9, wherein said mounting unit has a holding mechanism that holds bags manufactured by said bag manufacturing unit; and said holding mechanism holds bags in a holding position, which is fixed relative to said release position.

11. The bag manufacturing and packaging apparatus as set forth in claim 10, wherein said fixing position is spaced away from said holding position, and said mounting unit further has a transfer mechanism that transfers said holding mechanism such that bags held by said holding mechanism are moved from said holding position to said fixing position.

12. The bag manufacturing and packaging apparatus as set forth in claim 11, wherein said holding position and said fixing position are offset in the front-rear direction.

13. The bag manufacturing and packaging apparatus as set forth in claim 11, further comprising a control unit that is operatively coupled to said transfer mechanism and said fixing mechanism and is configured to control said transfer mechanism such that the bags do not interfere with said sealing members while being transferred.

14. A bag manufacturing and packaging apparatus, comprising:

a bag manufacturing unit that manufactures bags filled with articles; and a mounting unit that mounts bags manufactured by said bag manufacturing unit to a strip, said mounting unit having a holding mechanism having a main body and a pair of grasping arms for grasping ends of bags that are manufactured by said bag manufacturing unit, a rail disposed so as to be inclined from a frontward upper side to a rearward lower side, a sliding member repetitively movable along said rail, a supporting member fixedly coupled to said sliding member via a rod, said main body of said holding mechanism being fixedly attached to said supporting member, such that said sliding member, said supporting member, and said holding mechanism repetitively move diagonally together, and a fixing mechanism that affixes to the strip bags that are held by said holding mechanism and moved by said sliding member.

15. The bag manufacturing and packaging apparatus as set forth in claim 14, wherein said bag manufacturing unit includes a transverse sealing mechanism that seals vertical ends of bags, said transverse sealing mechanism having a motor and a pair of sealing members that grasps the ends of bags, and said sliding member is operatively coupled to said motor via a pulley, so as to be mechanically linked to movement of said sealing jaws.

* * * * *